US007537249B2

(12) United States Patent
Ichinose et al.

(10) Patent No.: US 7,537,249 B2
(45) Date of Patent: May 26, 2009

(54) LATCH DEVICE AND DEVICE FOR CONTROLLING OPENING/CLOSING OF DOOR

(75) Inventors: Mikio Ichinose, Yamanashi (JP); Etsuo Yamamoto, Yamanashi (JP); Michio Ohashi, Yamanashi (JP)

(73) Assignee: Mitsui Mining & Smelting Co., Ltd., Tokyo (JP)

( * ) Notice: Subject to any disclaimer, the term of this patent is extended or adjusted under 35 U.S.C. 154(b) by 100 days.

(21) Appl. No.: 11/439,126

(22) Filed: May 24, 2006

(65) Prior Publication Data

US 2006/0267350 A1 Nov. 30, 2006

(30) Foreign Application Priority Data

May 24, 2005 (JP) ..... 2005-151070
May 24, 2005 (JP) ..... 2005-151071
May 24, 2005 (JP) ..... 2005-151072

(51) Int. Cl.
*E05C 3/16* (2006.01)
*E05C 3/06* (2006.01)

(52) U.S. Cl. ..... 292/216; 292/201; 292/341.16; 292/DIG. 23

(58) Field of Classification Search ..... 292/201, 292/216, DIG. 23, 340, 341.15, 341.16, DIG. 42
See application file for complete search history.

(56) References Cited

U.S. PATENT DOCUMENTS 4,886,307 A * 12/1989 Ruckert ..... 292/216
5,516,164 A * 5/1996 Kobayashi ..... 292/201
5,876,074 A * 3/1999 Dowling ..... 292/201
6,422,615 B1 * 7/2002 Roos et al. ..... 292/216
6,422,617 B1 * 7/2002 Fukumoto et al. ..... 292/216
6,435,573 B1 * 8/2002 Szablewski ..... 292/201
6,550,826 B2 * 4/2003 Fukushima et al. ..... 292/201
6,565,131 B2 * 5/2003 Roos ..... 292/201
6,568,720 B1 * 5/2003 Szablewski ..... 292/201
6,629,710 B1 * 10/2003 Shafry et al. ..... 292/216

(Continued)

FOREIGN PATENT DOCUMENTS

DE 198 35 994 A1 2/2000

(Continued)

OTHER PUBLICATIONS

Electronic Translation of EP 1 455 040 A2, European Patent Office Website, < http://gb.espacenet.com/search97cgi/s97_cgi.exe?Action=FormGen&Template=gb/EN/home.hts>.*

*Primary Examiner*—Patricia L Engle
*Assistant Examiner*—Alyson M Merlino
(74) *Attorney, Agent, or Firm*—Foley & Lardner LLP

(57) ABSTRACT

To accurately control opening and closing of a door, a device includes an opening/closing switch lever arranged at an opening end of a striker receiving groove, and configured to shift between a retreated position and an advanced position. When a striker is positioned in an engagement groove of a latch, the opening/closing switch lever is positioned at the retreated position, and when the striker is removed from the engagement groove and then from a receiving groove, the opening/closing switch lever is positioned at the advanced position. The device further includes an opening/closing switch that performs a switching operation when the opening/closing switch lever that has been positioned at the advanced position shifts toward the retreated position.

3 Claims, 19 Drawing Sheets

U.S. PATENT DOCUMENTS

| | | | | |
|---|---|---|---|---|
| 6,637,783 | B2 * | 10/2003 | Takamura | 292/201 |
| 6,659,515 | B2 * | 12/2003 | Raymond et al. | 292/201 |
| 7,434,853 | B2 * | 10/2008 | Yamamoto et al. | 292/216 |
| 2002/0117862 | A1 * | 8/2002 | Yamauchi et al. | 292/201 |
| 2003/0001397 | A1 * | 1/2003 | Mork et al. | 292/216 |
| 2003/0067175 | A1 * | 4/2003 | Shiota et al. | 292/201 |
| 2004/0245786 | A1 * | 12/2004 | Hashiba et al. | 292/216 |

FOREIGN PATENT DOCUMENTS

| | | | |
|---|---|---|---|
| EP | 1 455 040 | A2 | 9/2004 |
| JP | 2001-182407 | A | 7/2001 |

* cited by examiner

LATCH DEVICE AND DEVICE FOR CONTROLLING OPENING/CLOSING OF DOOR

BACKGROUND OF THE INVENTION

1. Field of the Invention

The present invention relates to a technology for controlling opening/closing of a door of a vehicle.

2. Description of the Related Art

A latch device is provided between a main body and a door of a vehicle, and opening and closing of the door are controlled with the latch device. For example, a latch device controls not to open a door when a striker is engaged with a latch, and allows the door to be opened when the latch is released. Such a technology is disclosed in, for example, Japanese Patent Application Laid-Open No. 2001-182407.

In recent years, vehicles are designed to facilitate operations thereof, and an operation of a door is also demanded to be easy.

In the above conventional technology, the latch device is provided with a closing mechanism that is driven by an actuator. With this closing mechanism, when the latch moves from an open position to a half-latch position, the actuator is driven to succeed a door closing operation. Thus, a subsequent closing operation to a full-latch position is automatically performed, thereby making the door closing operation easy.

However, in the above latch device, if a detecting unit that detects a position of the latch, detects a position erroneously, the door may not be closed properly. For example, when the detecting unit erroneously detects that the latch has moved to the half-latch position, the latch is brought to the full-latch position even if the door is not closed. Therefore, when the door is actually closed, the latch and the striker cannot engage with each other. As a result, the door cannot be maintained in a closed state.

In another conventional technology, a latch engaging operation and a door opening movement are respectively driven by actuators. In the technology, a latch device is provided with a latch actuator that moves a striker and a latch to a full-latch state when the striker and the latch are brought to a half-latch state by a closing operation of the door. In addition, an open actuator is provided between a main body of a vehicle and the door. The open actuator moves the door to a fully opened position when the latch is released by a door opening operation. Thus, the operation of the door is facilitated.

Even when the latch is released, the striker may be positioned in an engagement groove of the latch. In such a condition, the latch is easily brought to the half-latch state even with a small shock, for example, when the door is touched lightly. If the latch is thus brought to the half-latch state, the open actuator and the latch actuator both operate to drive the door in opposite directions at the same time.

SUMMARY OF THE INVENTION

It is an object of the present invention to at least solve the problems in the conventional technology.

A latch device according to one aspect of the present invention drives a latch actuator to bring a striker and a latch in a first engagement state to a second engagement state so that a door to which the latch device is provided is maintained in a closed state. The latch device includes a detecting unit configured to output a signal when the striker enters a groove in which the striker is fit. The latch actuator is actuated when the detecting unit outputs the signal while the striker and the latch are in the first engagement state.

A latch device according to another aspect of the present invention restricts an opening movement of a door when a latch operates to engage with a striker when a striker is positioned in an engagement groove of the latch, the engagement groove at which the striker is engaged with the latch, and that allows an opening movement of the door when the latch operates to release the striker to remove the striker from the engagement groove. The latch device includes a detecting unit configured to output a signal when the striker is removed from the engagement groove.

A door opening/closing control device according to still another aspect of the present invention drives a latch actuator to bring a striker and a latch in a first engagement state to a second engagement state so that a door to which the door opening/closing control device is provided is maintained in a closed state, and allows an opening movement of the door when the latch operates to release the striker to remove the striker from the engagement groove. The door opening/closing control device includes a detecting unit configured to output a signal when the striker is removed from the engagement groove. The door opening/closing control device is configured to drive an open actuator to open the door when the detecting unit outputs the signal.

The other objects, features, and advantages of the present invention are specifically set forth in or will become apparent from the following detailed description of the invention when read in conjunction with the accompanying drawings.

DETAILED DESCRIPTION OF THE PREFERRED EMBODIMENTS

Figure 1:
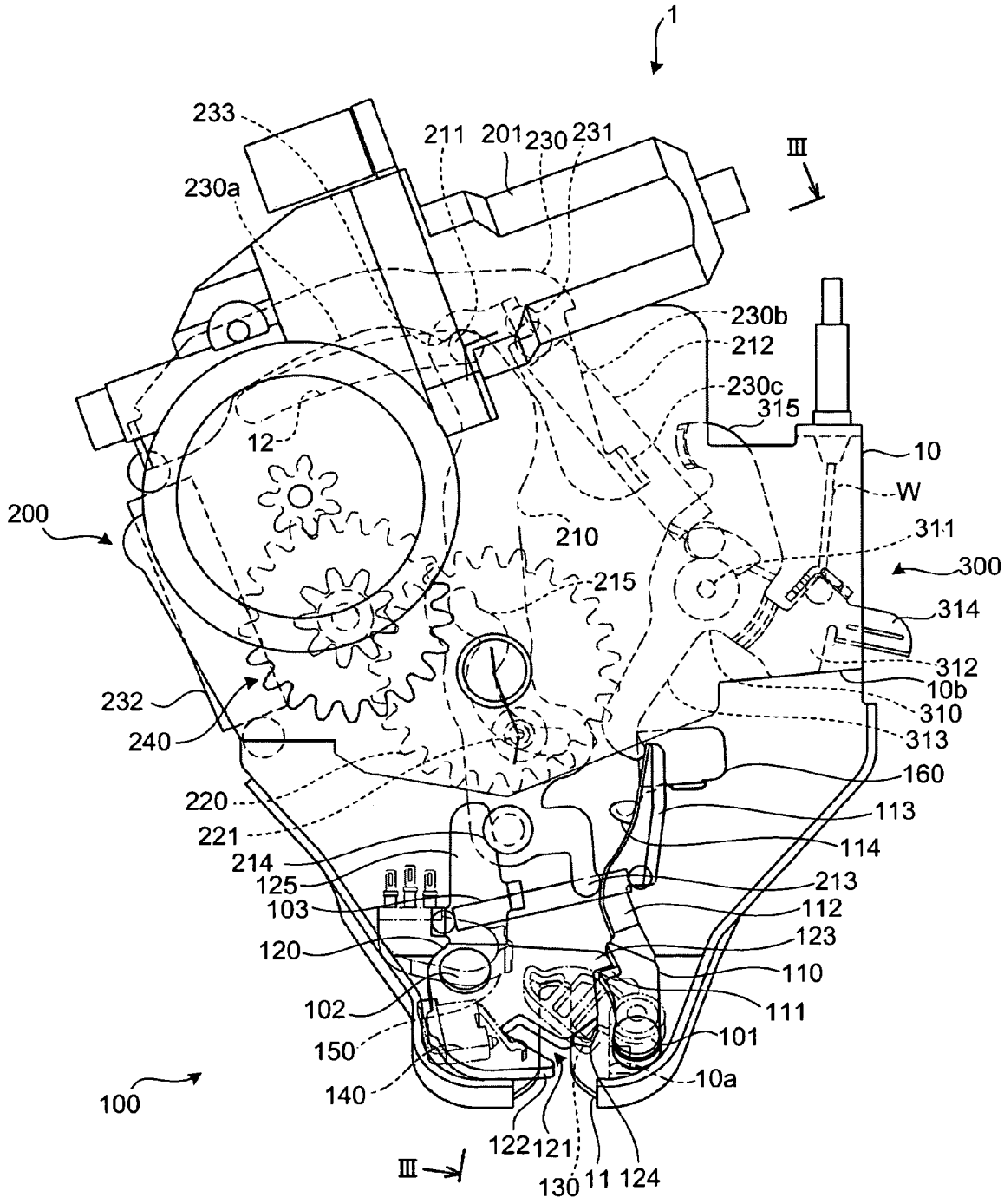
FIG. 1 is a front view of a latch device according to an embodiment of the present invention.
Figure 2:
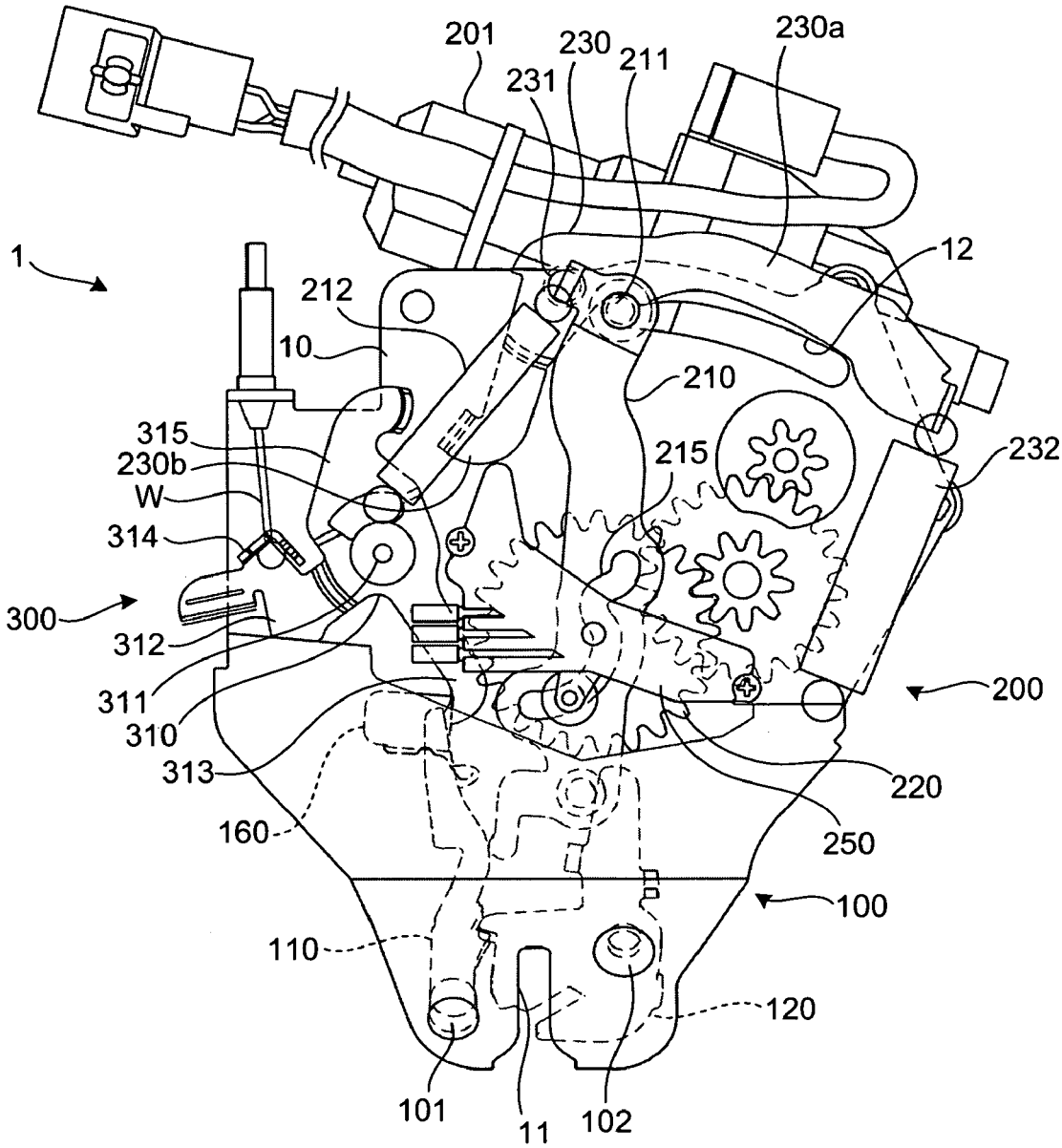
FIG. 2 is a rear view of the latch device.
Figure 3:
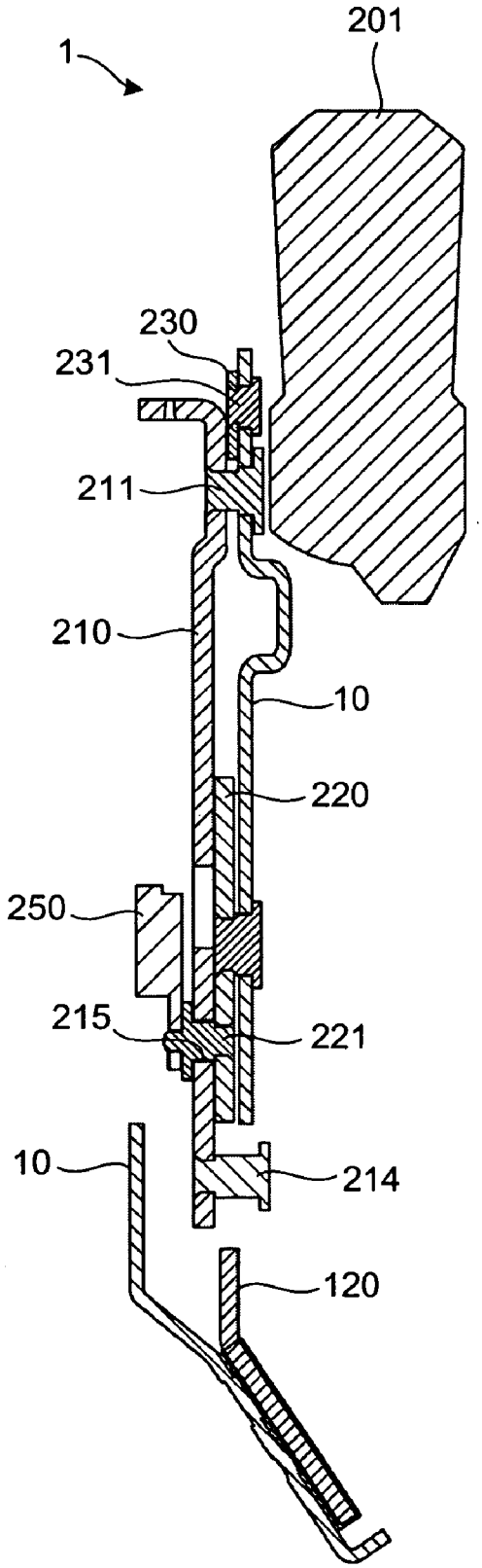
FIG. 3 is a cross-section of the latch device taken along a line III-III shown in FIG. 1.
Figure 4:
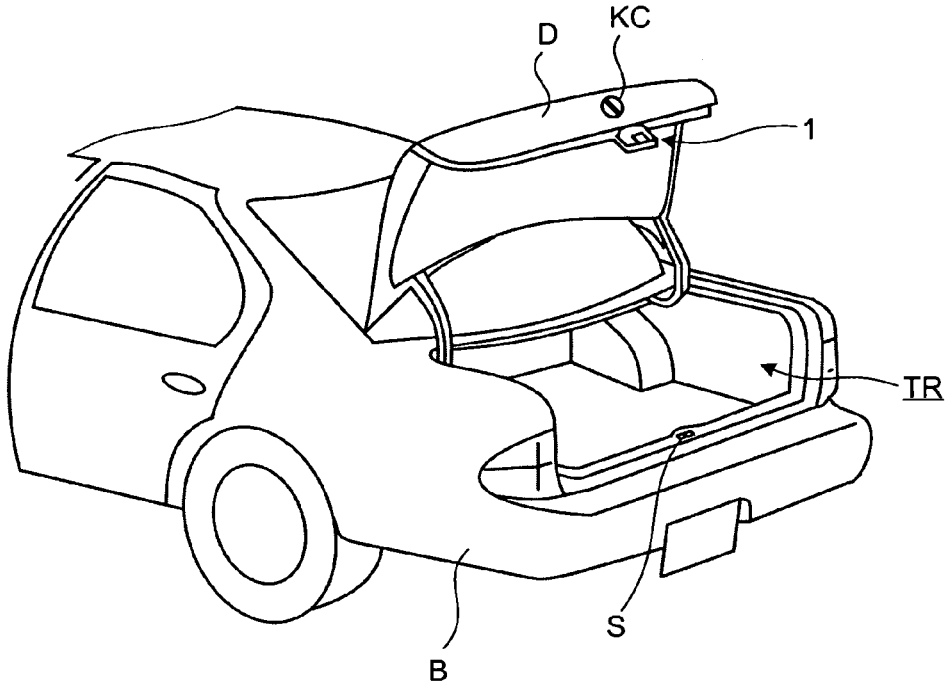
FIG. 4 is a perspective view of a vehicle to which the latch device is applied.

Exemplary embodiments according to the present invention will be explained in detail below with reference to the accompanying drawings. FIGS. 1 to 3 are schematics of a latch device according to an embodiment of the present invention. The latch device is applied to a door (hereinafter, "trunk lid D") for opening and closing a trunk room TR provided in a main body B of a vehicle as shown in FIG. 4, and keeps the trunk lid D in the closed state. A sedan type four-wheel vehicle is shown in the figure as an example. In this vehicle, whereas a striker S is fixed to the main vehicle body B, a latch device 1 is provided on the trunk lid D. A power trunk unit (not shown) that automatically opens and closes the trunk lid D by the driving of an open actuator OA is disposed between the trunk lid D and the main vehicle body B. A weather strip, formed from an elastic material, is furthermore disposed between the periphery of the trunk lid D and the main vehicle body B.

As shown in FIGS. 1 to 3, the latch device 1 includes a latch mechanism 100, an actuator driving mechanism 200, and a manual operating unit 300 that are disposed on a base plate (main device body) 10.

The base plate 10 serves as a basis when the latch device 1 is attached to the trunk lid D, and has a striker receiving groove 11 at a device portion corresponding to the striker S of the main vehicle body B, i.e., at a lower end of the base plate 10. The striker receiving groove 11 is a groove-like cutout that extends upward from the lower end of the base plate 10 and is positioned and sized so that the striker S can be guided and received when the trunk lid D is closed with respect to the main vehicle body B.

The latch mechanism 100 engages and holds the striker S when the trunk lid D is closed with respect to the main vehicle body B, and has a ratchet shaft 101 and a latch shaft 102 at right and left portions that sandwich the striker receiving groove 11. The ratchet shaft 101 supports a ratchet 110 in a swingable manner with respect to the base plate 10 and is disposed near an open end of the striker receiving groove 11. The latch shaft 102 serves to dispose a latch 120 rotatably with respect to the base plate 10, and is disposed near a rear end of the striker receiving groove 11.

The ratchet 110 of the latch mechanism 100 extends from the ratchet shaft 101 toward the rear end of the striker receiving groove 11, and has a latch engaging portion 111 and a ratchet operating portion 112.

The latch engaging portion 111 is a projection protruding from a side face of the ratchet 110 toward the striker receiving groove 11 near the rear end of the striker receiving groove 11.

The ratchet operating portion 112 extends beyond the rear end of the striker receiving groove 11, and has a bent edge portion 113 and a switch operating portion 114. The bent edge portion 113 is bent at a substantially right angle in a direction of separating from the base plate 10 and is disposed at an outer edge of the ratchet operating portion 112. The switch operating portion 114 protrudes from an inner edge of the ratchet operating portion 112 and along the surface of the base plate 10.

The latch 120 of the latch mechanism 100 has an engagement groove 121, a hook portion 122, a first mesh portion 123, a second mesh portion 124, and a latch operating portion 125.

The engagement groove 121 is a cutout formed in the direction of approaching the latch shaft 102 from an outer peripheral surface of the latch 120 and has sufficient width to receive the striker S. The engagement groove 121 intersects the striker receiving groove 11 sequentially from the open end toward the rear end of the striker receiving groove 11 when the latch 120 is rotated counterclockwise about the latch shaft 102 shown in FIG. 1.

The hook portion 122 is positioned at the open end side of the striker receiving groove 11 when the engagement groove 121 intersects the striker receiving groove 11.

The first mesh portion 123 and the second mesh portion 124 restrict the clockwise rotation of the latch 120 shown in FIG. 1 when these mesh portions contact the latch engaging portion 111 of the ratchet 110. When the first mesh portion 123 contacts the latch engaging portion 111, the hook portion 122 of the latch 120 is positioned at the open end of the striker receiving groove 11. When the second mesh portion 124 contacts the latch engaging portion 111, the hook portion 122 of the latch 120 is positioned at the rear end of the striker receiving groove 11. With respect to the striker receiving groove 11, the hook portion 122 protrudes to a position where the striker S can be hindered from passing through the striker receiving groove 11 when the latch engaging portion 111 contacts either of the first mesh portion 123 and the second mesh portion 124.

The latch operating portion 125 extends from a portion close to the latch shaft 102 in a manner corresponding to the ratchet operating portion 112 of the ratchet 110. The latch operating portion 125 is provided with a return spring 103 that urges the latch operating portion 125 and the ratchet operating portion 112 in directions in which these operating portions approach each other.

Though not illustrated in the figures, a latch cover is provided at a position of the surface of the base plate 10 at which the latch cover covers the ratchet 110 and the latch 120. This latch cover is also provided with a striker receiving groove that can receive the striker S when the trunk lid D is closed with respect to the main vehicle body B.

The latch mechanism 100 includes an opening/closing switch lever (lever member) 130, a door opening/closing switch (switch unit) 140, a latch switch 150, and a ratchet switch 160.

Figure 5:
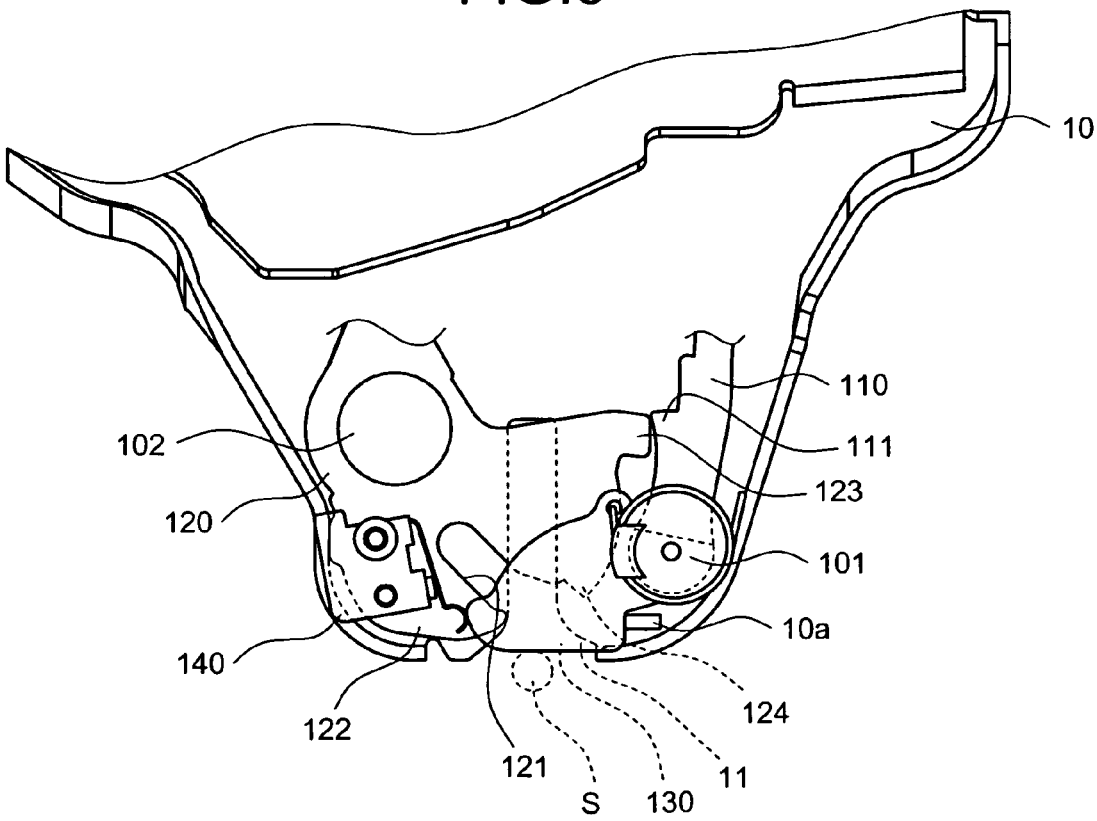
FIG. 5 is a schematic of principal portions of the latch device.
Figure 6:
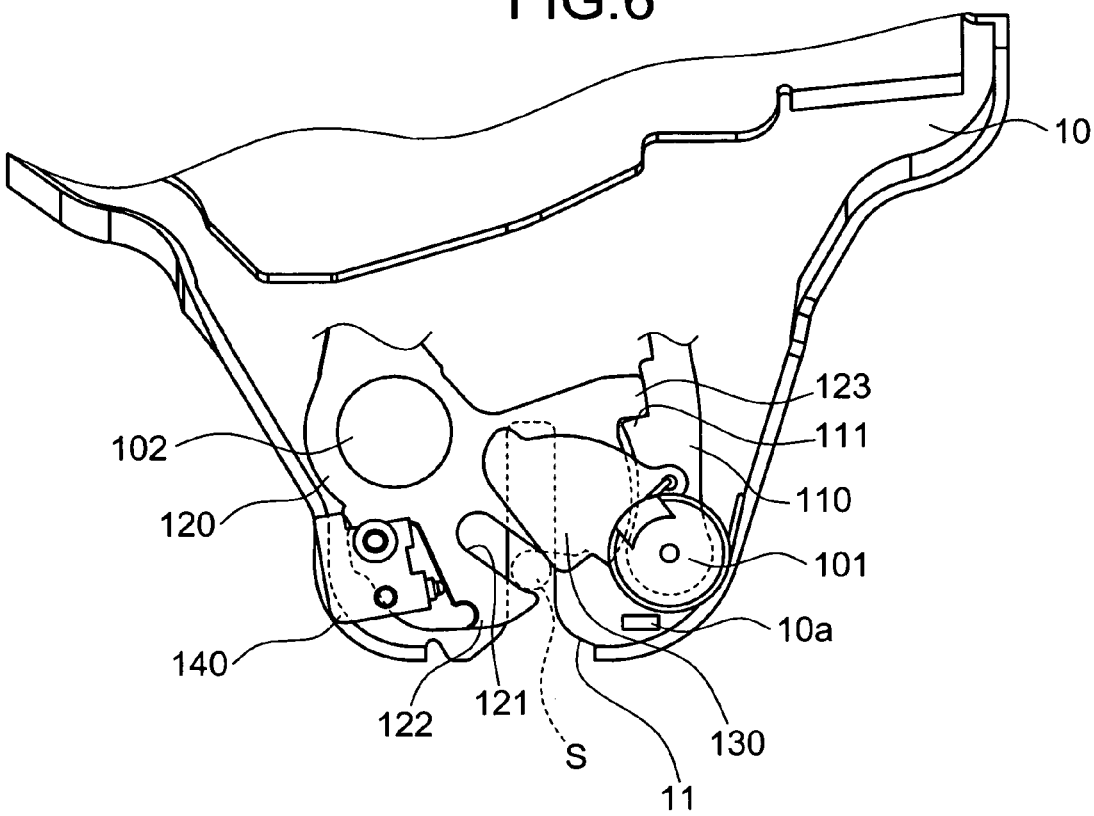
FIG. 6 is a schematic of principal portions of the latch device.
Figure 7:
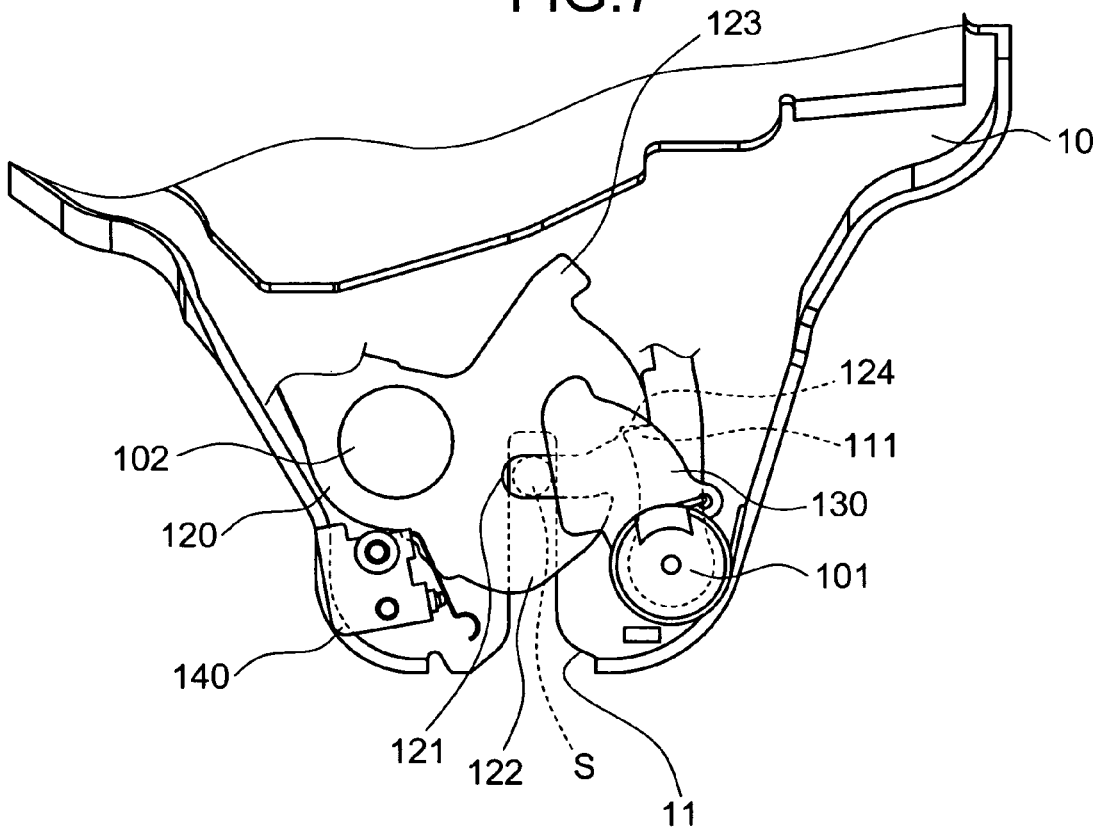
FIG. 7 is a schematic of principal portions of the latch device.

The opening/closing switch lever 130 extends radially outward from an extended end of the ratchet shaft 101 that protrudes to the surface of the latch cover, and can be displaced continuously between an advanced position and a retreated position by being swung about the ratchet shaft 101 independently of the ratchet 110. As shown in FIG. 5, when positioned at the advanced position, the opening/closing switch lever 130 is set in position by contact with a stopper 10*a* protruding from the base plate 10 and is put in a state of extending substantially perpendicular to and closing the open end of the striker receiving groove 11 formed in the base plate 10. As shown in FIG. 7, when the opening/closing switch lever 130 is positioned at the retreated position, a front end thereof extends incliningly so as to cover the rear end of the striker receiving groove 11 and the open end of the striker receiving groove 11 is thus opened.

Though not illustrated, the opening/closing switch lever 130 has a switch lever spring disposed between itself and the base plate 10. The switch lever spring constantly urges the opening/closing switch lever 130 in the direction of the stopper 10*a*.

The door opening/closing switch 140 is disposed on the surface of the latch cover at the opposite side of the opening/closing switch lever 130 across the striker receiving groove 11 and detects the positioning of the opening/closing switch lever 130 at the advanced position.

The latch switch 150 is a rotary switch that detects the rotational position of the latch 120 with respect to the base plate 10 and is disposed on the surface of the latch cover in a manner such that the center of its rotation axis matches the axis center of the latch shaft 102.

The ratchet switch 160 is disposed at a position at which it is operated by the switch operating portion 114 of the ratchet 110 and outputs a detection signal respectively when the latch engaging portion 111 contacts the first mesh portion 123 of the latch 120 and when the latch engaging portion 111 contacts the second mesh portion 124.

Meanwhile, the actuator driving mechanism 200 of the latch device 1 operates the ratchet 110 and the latch 120 by driving a latch actuator 201 and has an output lever 210, which is a first lever, and a cam driving gear 220.

The output lever 210 has a lever shaft 211 at its base end. By fitting the lever shaft 211 in a slide groove 12 of the base plate 10, the output lever 210 can be swung about the axis center of the lever shaft 211 and the lever shaft 211 can be slid and moved along the slide groove 12. The slide groove 12 is formed at an upper edge of the base plate 10 and is shaped like a circular arc that is convex outwardly from the base plate 10.

A lever spring 212 and a cancel lever 230 are disposed between the base end of the output lever 210 and the base plate 10. The lever spring 212 is interposed between the base end of the output lever 210 and the base plate 10 and urges the lever shaft 211 of the output lever 210 so that the lever shaft 211 is constantly positioned at a right end of the slide groove 12.

The cancel lever 230 is swingably disposed on the base plate 10 via a cancel shaft 231 disposed near the right end of the slide groove 12 and has integrally formed thereon a curved portion 230*a* and a pressing operating portion 230*b*. The curved portion 230*a* extends curvingly along the slide groove 12 of the base plate 10 from the cancel shaft 231 and has a supporting projection 233 at a portion of a curved inner surface that corresponds to the right end of the slide groove 12. The supporting projection 233 contacts a left peripheral surface of the lever shaft 211 of the output lever 20 when the lever shaft 211 is positioned at the right end of the slide groove 12 and restricts the leftward sliding movement of the lever shaft 211. The pressing operating portion 230*b* extends downward from the cancel shaft 231 and has a pressure receiving portion 230*c* at an outer edge of its extended end. The pressure receiving portion 230*c* is bent so as to extend perpendicular to the surface of the base plate 10 from the extended end of the pressing operating portion 230*b*. The cancel lever 230 has a cancel spring 232 disposed between a front end of the curved portion 230*a* and the base plate 10. The cancel spring 232 exerts an urging force so that the curved inner surface of the cancel lever 230 contacts and presses the peripheral surface of the lever shaft 211. The cancel spring 232 has a spring constant sufficiently greater than the lever spring 212 described above.

The output lever 210 also has a release lever portion 213 and a latch pin 214 disposed at front end portions positioned between the ratchet operating portion 112 and the latch operating portion 125.

The release lever portion 213 is a lever-like portion provided so as to face the bent edge portion 113 of the ratchet operating portion 112 from the front end of the output lever 210. The release lever portion 213 is enabled to press the ratchet 110 via the bent edge portion 113 and the ratchet operating portion 112 when the output lever 210 swings about the axis center of the lever shaft 211.

The latch pin 214 is a pillar-shaped portion protruding from the front end of the output lever 210. The latch pin 214 is enabled to press the latch 120 via the latch operating portion 125 when the output lever 210 swings about the axis center of the lever shaft 211.

The cam driving gear 220 is rotatably disposed at a portion of the base plate 10 that corresponds to an intermediate portion of the output lever 210. When the latch actuator 201 is driven, the cam driving gear 220 is rotated in one direction, i.e., the clockwise direction in FIG. 1, via a gear train 240.

The cam driving gear 220 is provided with a cam pin 221 at an end surface that faces the output lever 210. The cam pin 221 protrudes from the end surface of the cam driving gear 220 and is linked to a cam groove 215 formed at an intermediate portion of the output lever 210. When the cam driving gear 220 rotates clockwise, the cam groove 215 causes the output lever 210 to swing suitably via the cam pin 221 and causes the ratchet 110 and the latch 120 to sequentially perform a series of operations, to be described later, via the release lever portion 213 and the latch pin 214.

Though not illustrated in the figures, in the present embodiment, an electric motor, including an output shaft provided with a worm gear, is used as the latch actuator 201, and a gear train, having a worm wheel that meshes with the worm gear, is used as the gear train 240. Symbol 250 in FIG. 2 indicates a cam-pin-position detecting switch 250 that detects a change in position of the cam pin 221 that accompanies the rotation of the cam driving gear 220.

The manual operating portion 300 of the latch device 1 has an open lever 310, which is a second lever, disposed on the base plate 10. The open lever 310 is disposed rotatably via an open lever shaft 311 on a portion at the right side of the cam driving gear 220 in FIG. 1 and includes an initial position defining portion 312, a latch release operating portion 313, a lever operating portion 314, and a cancel operating portion 315.

When the open lever 310 rotates clockwise in FIG. 1, the initial position defining portion 312 contacts a defining surface 10*b* of the base plate 10 and the open lever 310 is thereby set at an initial position. When the open lever 310 is set at the initial position, it can rotate only in the counterclockwise direction in FIG. 1. The latch release operating portion 313 extends downwards from the open lever shaft 311 when the open lever 310 is set at the initial position and an extended end thereof faces the bent edge portion 113 of the ratchet 110. The lever operating portion 314 extends radially outward beyond the initial position defining portion 312. One end of a wire cable W is connected to the lever operating portion 314. Though not illustrated in the figures, the other end of the wire cable W is connected to a key cylinder KC of the trunk lid D and the wire cable W can thus be pullingly operated upward in FIG. 1 by a key operation. The cancel operating portion 315 extends upward from the open lever shaft 311 when the open lever 310 is set at the initial position and an extended end thereof faces the pressure receiving portion 230*c* of the cancel lever 230.

Though not illustrated in the figures, the open lever 310 has an initial position defining spring disposed between itself and the base plate 10. The initial position defining spring urges the initial position defining portion 312 of the open lever 310 in the direction of constantly pressing against the defining surface 10*b* of the base plate 10.

When the open lever 310 with the above arrangement is rotated counterclockwise in FIG. 1, the latch release operating portion 313 contacts the bent edge portion 113 of the ratchet 110 so that the ratchet 110 can be swung clockwise and the cancel operating portion 315 contacts the pressure receiving portion 230*c* of the cancel lever 230 so that the cancel lever 230 can be swung clockwise. In the present embodiment, the interval between the cancel operating portion 315 and the pressure receiving portion 230*c* of the cancel lever 230 is set greater than the interval between the latch release operating portion 313 and the bent edge portion 113 of the ratchet 110 so that when the open lever 310 is rotated, the ratchet 110 swings first and the cancel lever 230 swings thereafter. More specifically, the intervals are set so that by the counterclockwise rotation of the open lever 310, the latch engaging portion 111 of the ratchet 110 is swung clockwise via the latch release operating portion 313 to a state of facing neither the first mesh portion 123 nor the second mesh portion 124 of the latch 120 and when the open lever 310 is thereafter rotated counterclockwise further, the supporting projection 233 of the cancel lever 230 is swung via the cancel operating portion 315 until it separates from the lever shaft 211 of the output lever 210.

Figure 8:
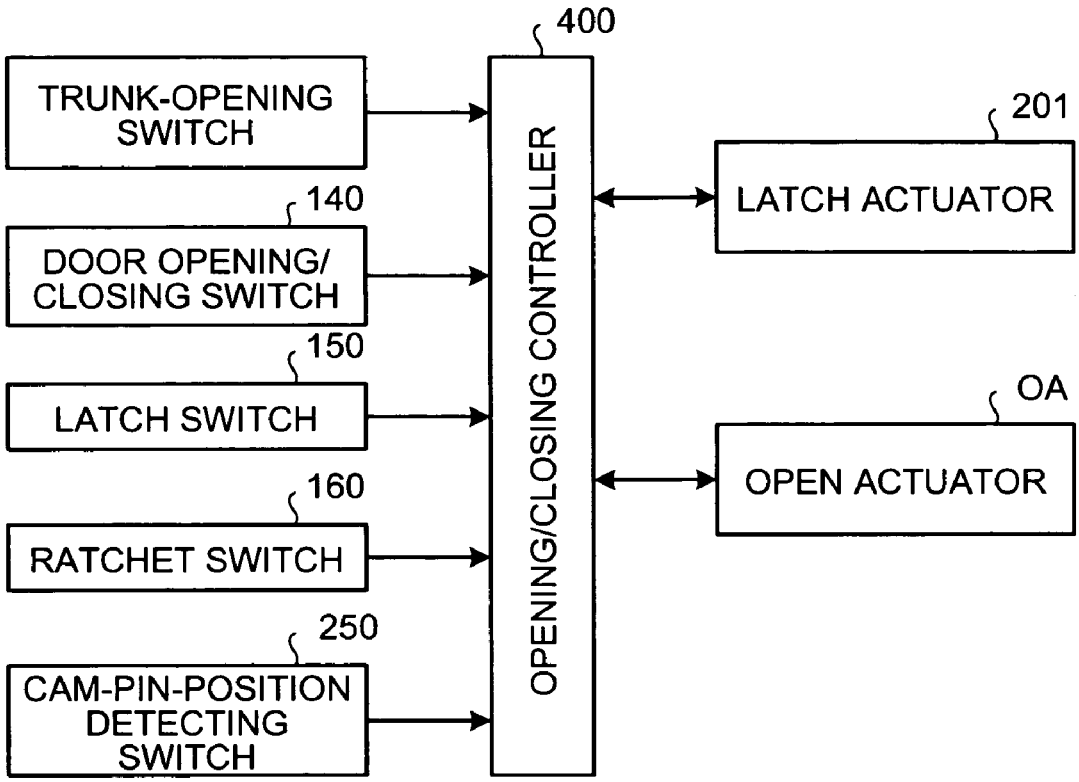
FIG. 8 is a block diagram of a door opening/closing control device according to an embodiment of the present invention.

FIG. 8 is an outline block diagram of a door opening/closing control device according to the present invention. The door opening/closing control device controls the latch device 1 described above. An opening/closing controller 400, shown in FIG. 8, suitably drives the latch actuator 201 and the open actuator OA of the power trunk unit based on the output results of the door opening/closing switch 140, the latch switch 150, the ratchet switch 160, and the cam-pin-position detecting switch 250 and an instruction from a trunk-opening switch to perform operations of opening and closing the trunk lid D. Though not illustrated in the figure, the trunk-opening switch is turned on when the trunk lid D is to be opened and is disposed, for example, on a portion of the main vehicle body B near the trunk lid D or on the trunk lid D.

FIGS. 9 to 15 are schematics for sequentially illustrating operations of the latch device 1. The operations of opening and closing the trunk lid D by means of the opening/closing controller 400 will now be described with reference to these figures.

Figure 9:
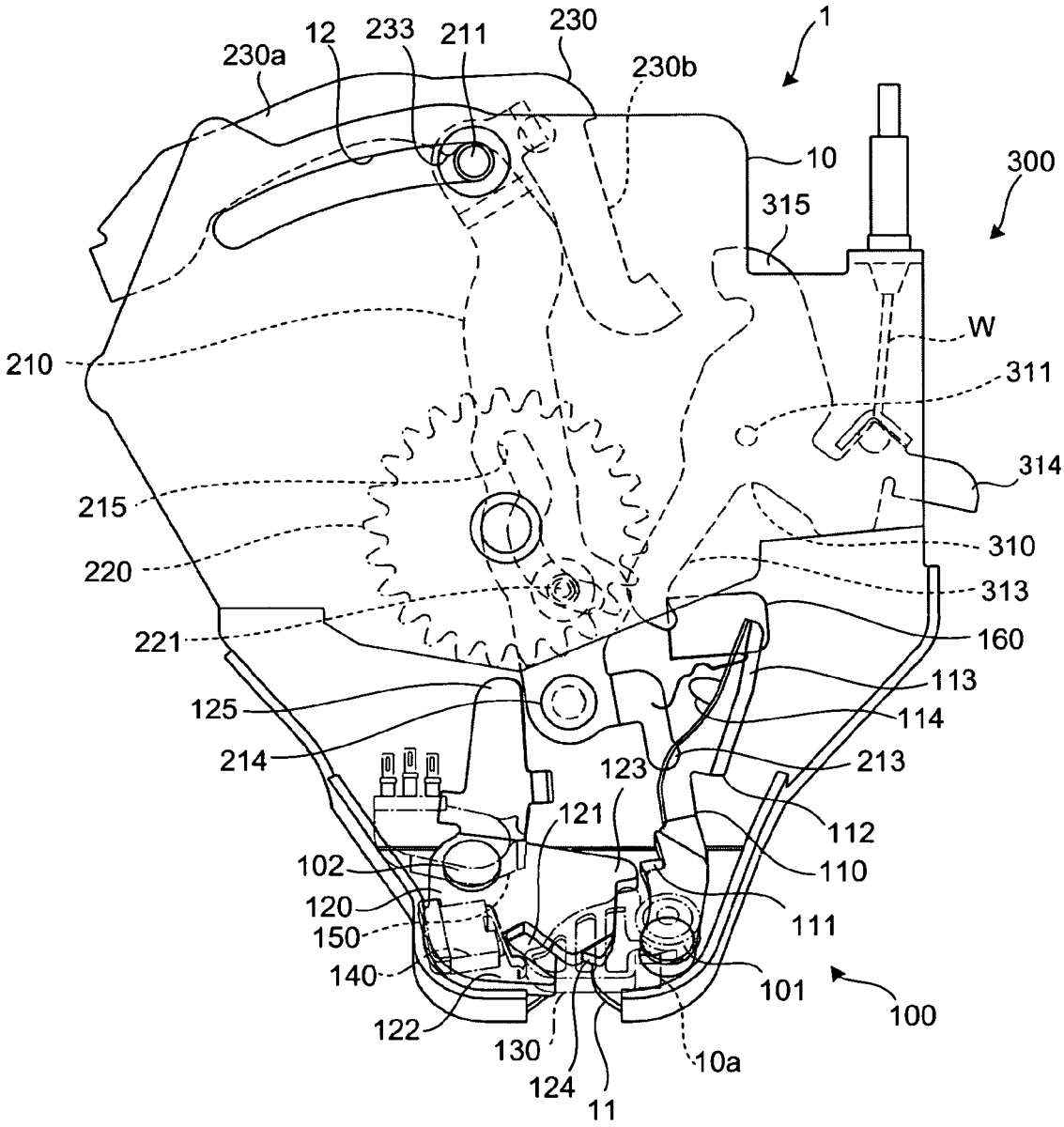
FIG. 9 is a schematic for illustrating an operation of the latch device.

With the latch device 1, when the trunk lid D is in the open state, the device is in an open-side neutral state of FIG. 9. That is, the latch 120 is positioned at a limit point upon rotating clockwise to the utmost limit, and the first mesh portion 123 of the latch 120 and the latch engaging portion 111 of the ratchet 110 are in a state before facing each other. At this time, the open end of the engagement groove 121 formed in the latch 120 is opened toward the open end of the striker receiving groove 11 formed in the base plate 10 and is inclined with respect to the striker receiving groove 11. With the output lever 210, the lever shaft 211 is positioned at the right end of the slide groove 12, and the release lever portion 213 and the latch pin 214 provided at the front end thereof are separated from the ratchet operating portion 112 and the latch operating portion 125, respectively. The opening/closing switch lever 130 is positioned at the advanced position and is in a state of extending substantially perpendicular to and closing the open end of the striker receiving groove 11.

When the trunk lid D is opened from the open-side neutral state of FIG. 9, the striker S provided on the main vehicle body B enters the striker receiving groove 11 of the base plate 10 and furthermore enters the engagement groove 121 of the latch 120. In accompaniment with the entry of the striker S into the striker receiving groove 11, the opening/closing switch lever 130 swings clockwise in FIG. 9 and the entry can thus be detected by the door opening/closing switch 140.

When the striker S proceeds along and enters the rear end of the striker receiving groove 11 according to the closing operation of the trunk lid D, the latch 120, with which the engagement groove 121 is inclined with respect to the striker receiving groove 11, is pushed by the striker S and rotates counterclockwise about the axis center of the latch shaft 102 (engaging operation). In this process, the side surface of the ratchet 110 is contacted against the peripheral surface of the latch 120 by the elastic force of the return spring 103 and is eventually held in a state in which the latch engaging portion 111 contacts the first mesh portion 123 of the latch 120.

Figure 10:
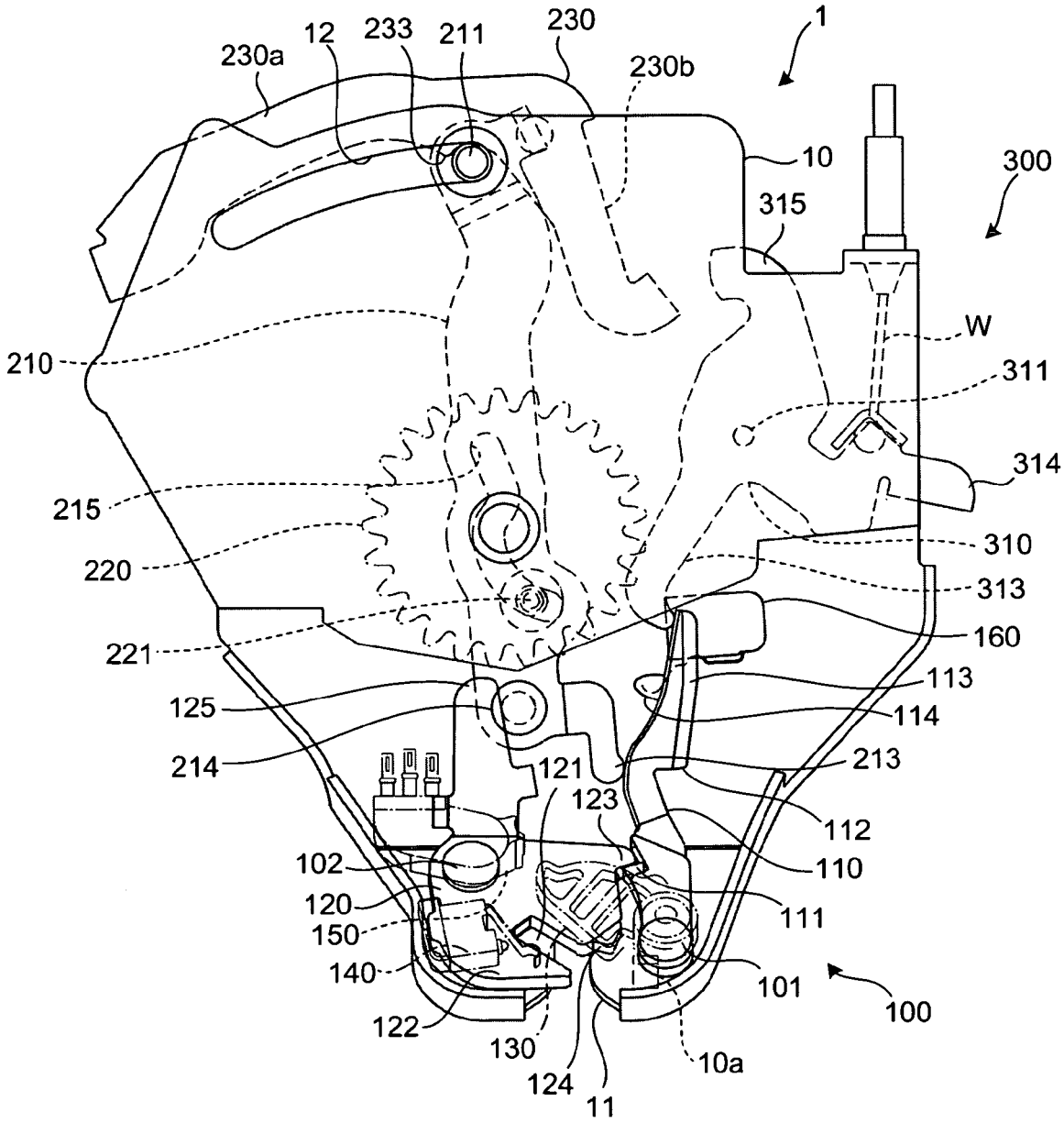
FIG. 10 is a schematic for illustrating an operation of the latch device.

In the state in which the latch engaging portion 111 of the ratchet 110 contacts the first mesh portion 123 of the latch 120, the clockwise rotation of the latch 120 about the latch shaft 102 is restricted against the elastic restoring force of the return spring 103 as shown in FIG. 10, and the hook portion 122 of the latch 120 engages with the striker S to prevent the removal of striker S from the engagement groove 121 of the latch 120. The latch device 1 and the striker S thus put the trunk lid D not into a completely closed state with respect to the main vehicle body B but into a half-latch state (first engagement state), in which the movement in the opening direction is restricted.

When the opening/closing controller 400 judges that the latch device 1 is in the half-latch state shown in FIG. 10, that is, when after the entry of the striker S into the striker receiving groove 11 is detected by the door opening/closing switch 140, the opening/closing controller 400 judges that the latch device 1 is in the half-latch state based on the counterclockwise swinging of the ratchet 110 detected by the ratchet switch 160 and the rotation position of the latch 120 detected by the latch switch 150, the opening/closing controller 400 drives the latch actuator 201. Accordingly, the cam driving gear 220 rotates clockwise and, by actions of the cam pin 221 and the cam groove 215, the output lever 210 swings clockwise sequentially about the axis center of the lever shaft 211 positioned at the right end of the slide groove 12. Consequently, the latch pin 214 of the output lever 210 presses the latch operating portion 125 of the latch 120 and thereby starts the counterclockwise rotation of the latch 120 about the latch shaft 102. Here, though the latch engaging portion 111 of the ratchet 110 contacts the first mesh portion 123 of the latch 120, because the ratchet 110 swings suitably according to the outer peripheral shape of the latch 120, the latch engaging portion 111 never hinders the counterclockwise rotation of the latch 120.

Figure 11:
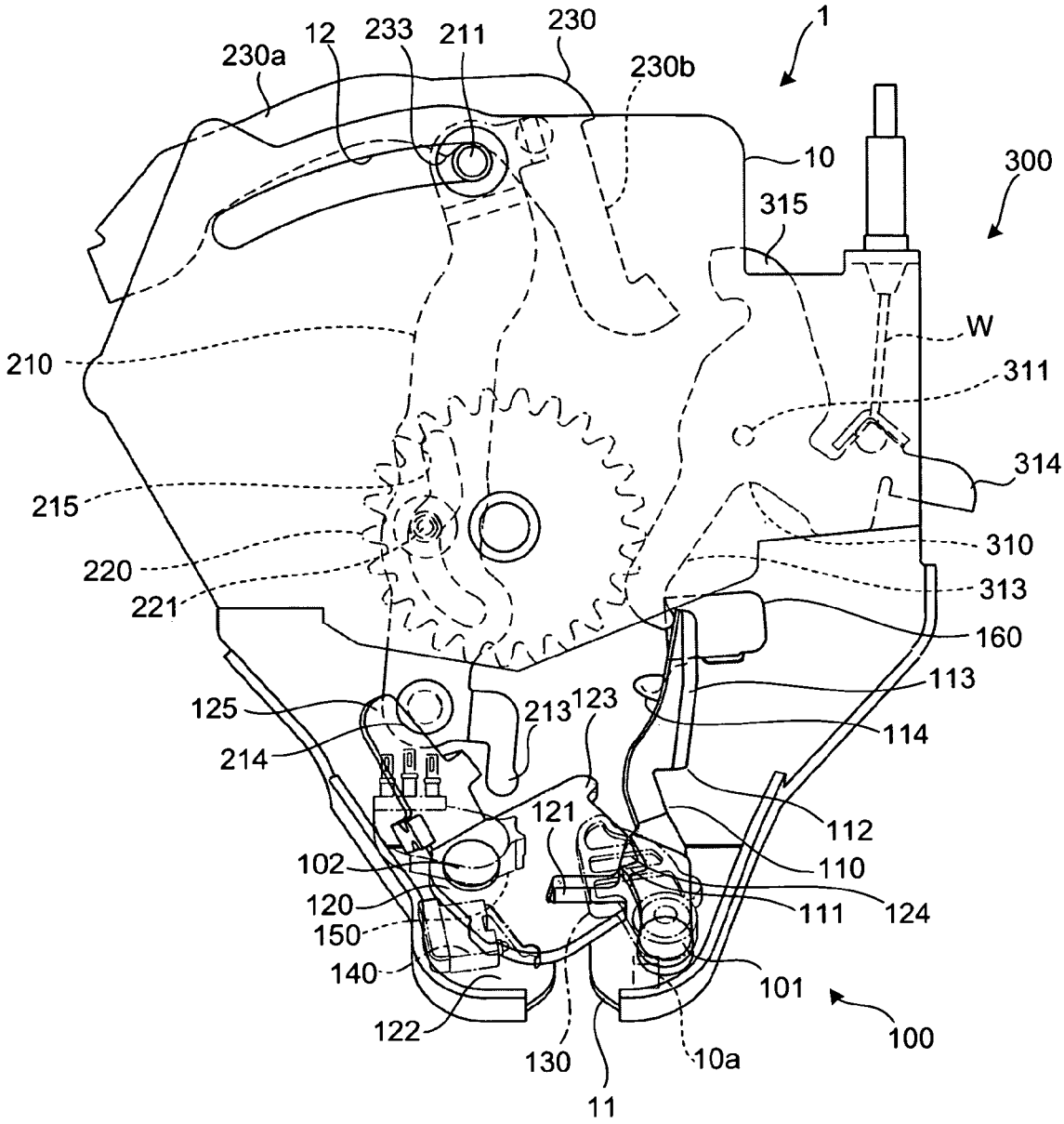
FIG. 11 is a schematic for illustrating an operation of the latch device.

Upon rotating counterclockwise from the half-latch state shown in FIG. 10, the latch 120 is eventually held in a state in which the latch engaging portion 111 contacts the second mesh portion 124 of the latch 120. In the state in which the latch engaging portion 111 of the ratchet 110 contacts the second mesh portion 124 of the latch 120, the clockwise rotation of the latch 120 about the latch shaft 102 is restricted against the elastic restoring force of the return spring 103 as shown in FIG. 11, and the hook portion 122 of the latch 120 engages with the striker S to prevent the removal of the striker S from the engagement groove 121 of the latch 120. Moreover, in the interval between the half-latch state shown in FIG. 10 and the state shown in FIG. 11, the latch 120 operates so as to draw the striker S into the rear end of the striker receiving groove 11. The latch device 1 and the striker S thus close the trunk lid D completely with respect to the main vehicle body B and bring the trunk lid D into a full-latch state (second engagement state), in which the movement in the opening direction is restricted, against the elastic force of the weather strip. In accompaniment with the entry of the striker S, the opening/closing switch lever 130 swings sequentially to the retreated position and thus never hinders the transition from the half-latch state to the full-latch state.

Figure 12:
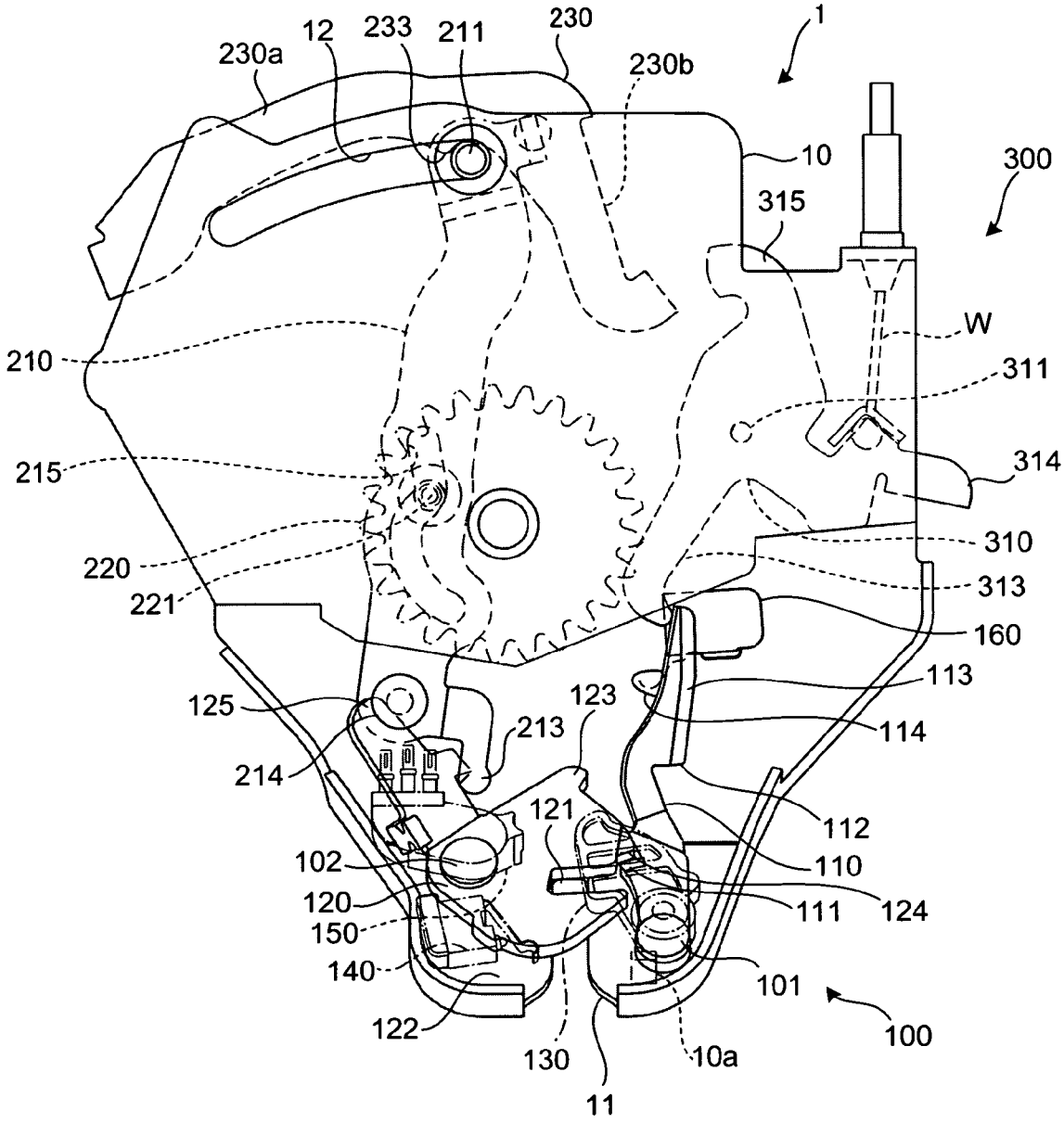
FIG. 12 is a schematic for illustrating an operation of the latch device.

When the opening/closing controller 400 judges that the latch device 1 has transitioned into the full-latch state shown in FIG. 11, that is, when the opening/closing controller 400 judges that the latch device 1 is in full-latch state based on the counterclockwise swinging of the ratchet 110 detected by the ratchet switch 160 and the rotation position of the latch 120 detected by the latch switch 150, the opening closing controller 400 continues to drive the latch actuator 201 to swing the output lever 210 in the same direction so that the latch-side overstroke state, shown in FIG. 12, is entered. The latch engaging portion 111 of the ratchet 110 can thereby be put into contact reliably with the second mesh portion 124 of the latch 120.

After the latch-side overstroke state shown in FIG. 12 is entered, the opening/closing controller 400 continues to drive the latch actuator 201 to swing the output lever 210 counterclockwise. The driving of the latch actuator 201 is thereafter stopped according to the detection result of the cam-pin-position detecting switch 250 when the latch device 1 is put in the closed-side neutral state shown in FIG. 13. In the closed-side neutral state shown in FIG. 13, the latch engaging portion 111 of the ratchet 110 contacts the first mesh portion 123 of the latch 120 engaged with the striker S. Furthermore, the lever shaft 211 of the output lever 210 being positioned at the right end of the slide groove 12, the release lever portion 213 and the latch pin 214 are positioned away from the ratchet operating portion 112 and the latch operating portion 125, respectively. The trunk lid D is thus held in a state of being closed with respect to the main vehicle body B.

With the latch device 1, during the above operations, the latch actuator 201 is driven only when, after the entry of the striker S into the striker receiving groove 11 is detected by the door opening/closing switch 140, the latch device 1 is judged to be in the half-latch state based on the counterclockwise swinging of the ratchet 110 detected by the ratchet switch 160 and the rotation position of the latch 120 detected by the latch switch 150. Thus, even when, for example, the ratchet switch 160 erroneously detects the swinging of the ratchet 110, the latch 120 does not rotate clockwise about the axis center of the latch shaft 102. Thus, when the trunk lid D is closed, the striker S always enters the engagement groove 121 of the latch 120 and the trunk lid D can thus be closed reliably with respect to the main vehicle body B.

Figure 13:
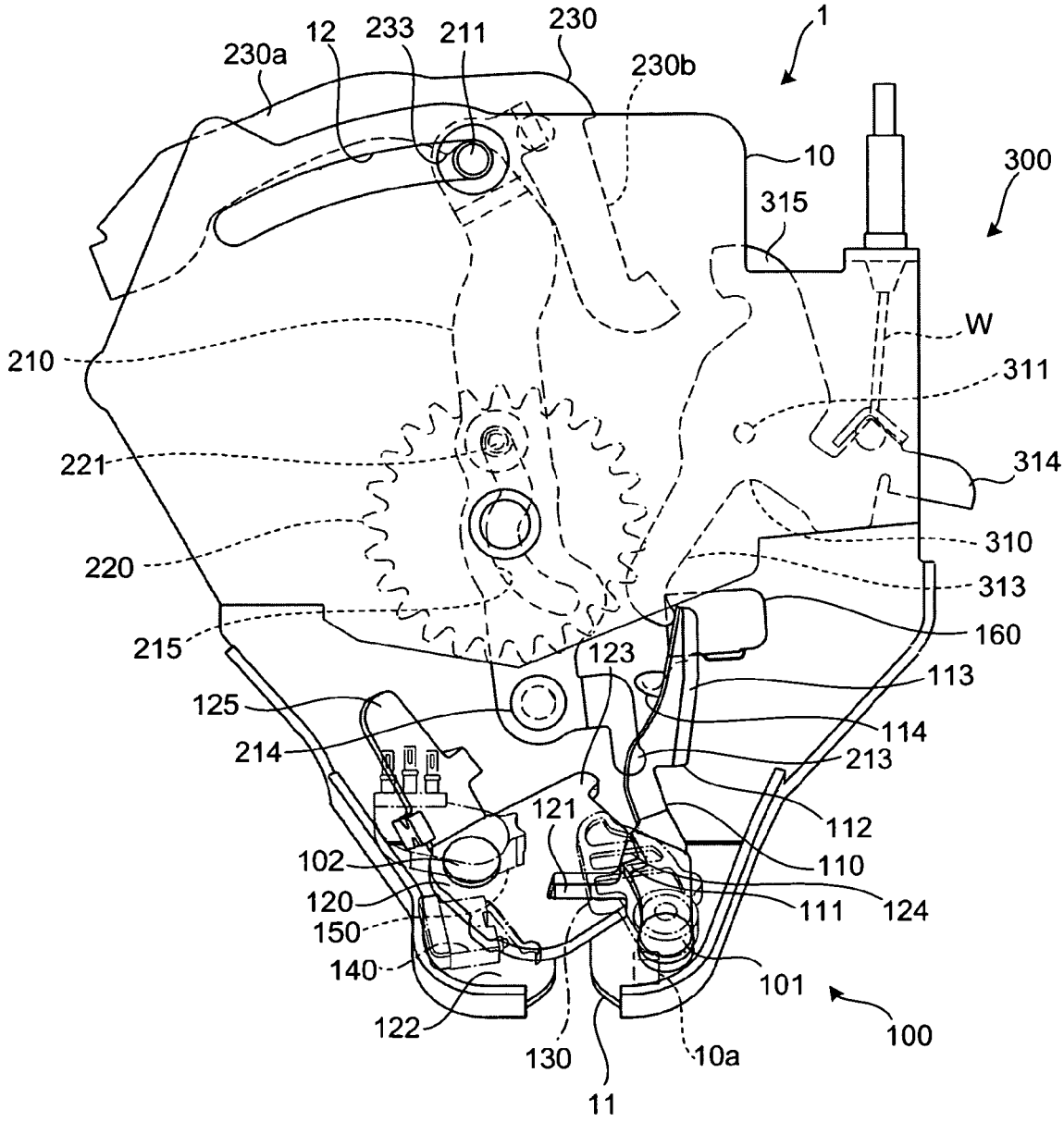
FIG. 13 is a schematic for illustrating an operation of the latch device.

When a driver turns on a trunk-opening switch in the closed-side neutral state shown in FIG. 13, this is detected by the opening/closing controller 400, which then drives the latch actuator 201 of the latch device 1 to rotate the cam driving gear 220 clockwise. Then by the actions of the cam pin 221 and the cam groove 215, the output lever 210 starts swinging counterclockwise sequentially about the axis center of the lever shaft 211.

Figure 14:
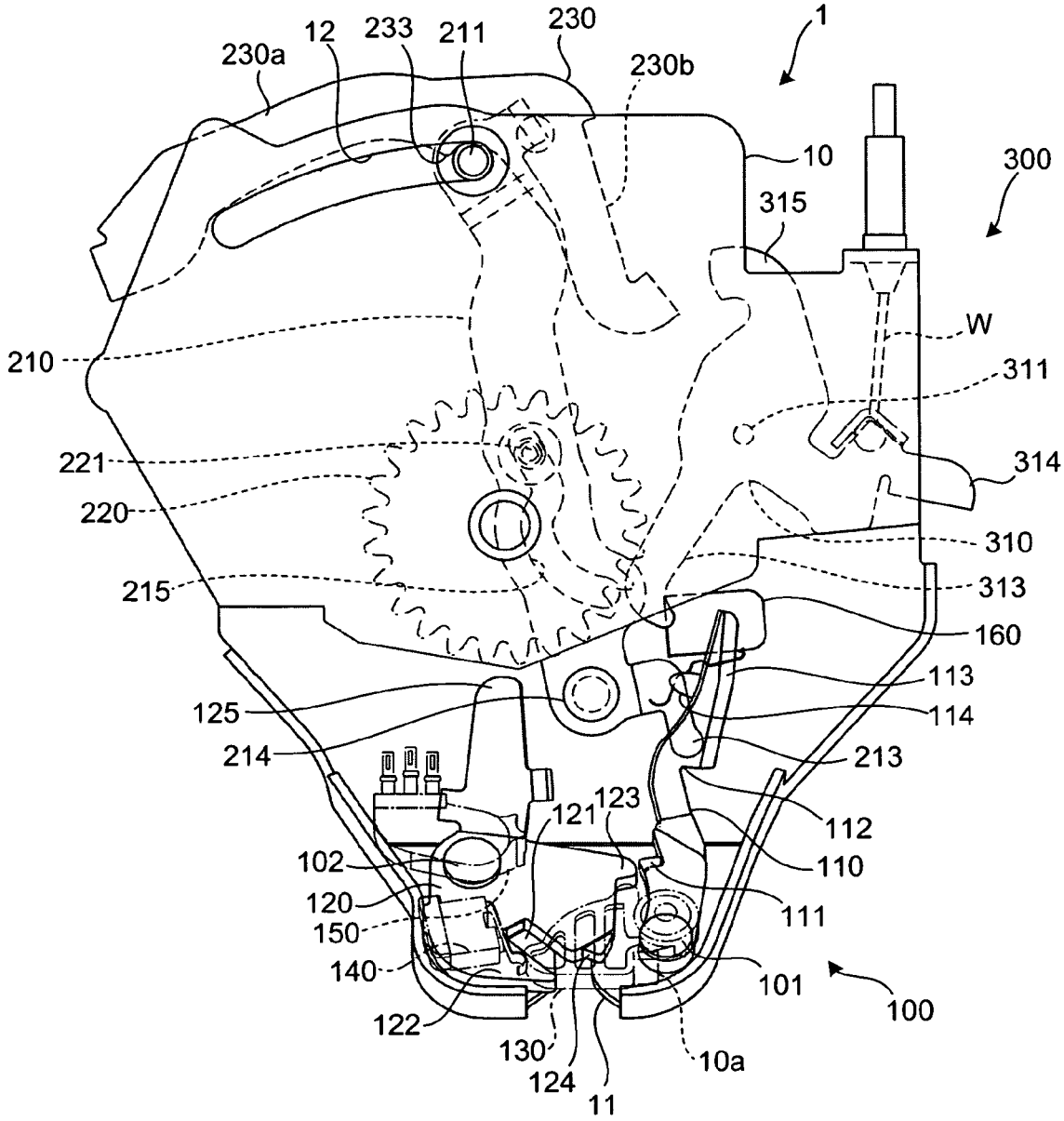
FIG. 14 is a schematic for illustrating an operation of the latch device.

When the output lever 210 swings counterclockwise about the axis center of the lever shaft 211 positioned at the right end of the slide groove 12, the release lever portion 213 of the output lever 210 presses the ratchet operating portion 112 of the ratchet 110 so that the ratchet 110 swings clockwise about the ratchet shaft 101 against the elastic force of the return spring 103 and the contact of the second mesh portion 124 of the latch 120 with the latch engaging portion 111 is released as shown in FIG. 14. Because the latch 120 is thus rotated clockwise about the latch shaft 102 by the elastic restoring force of the return spring 103, the engagement groove 121 of the latch 120 is opened and the striker S is put in a state in which it can be removed from the engagement groove 121 of the latch 120 and the striker receiving groove 11 of the base plate 10.

Figure 15:
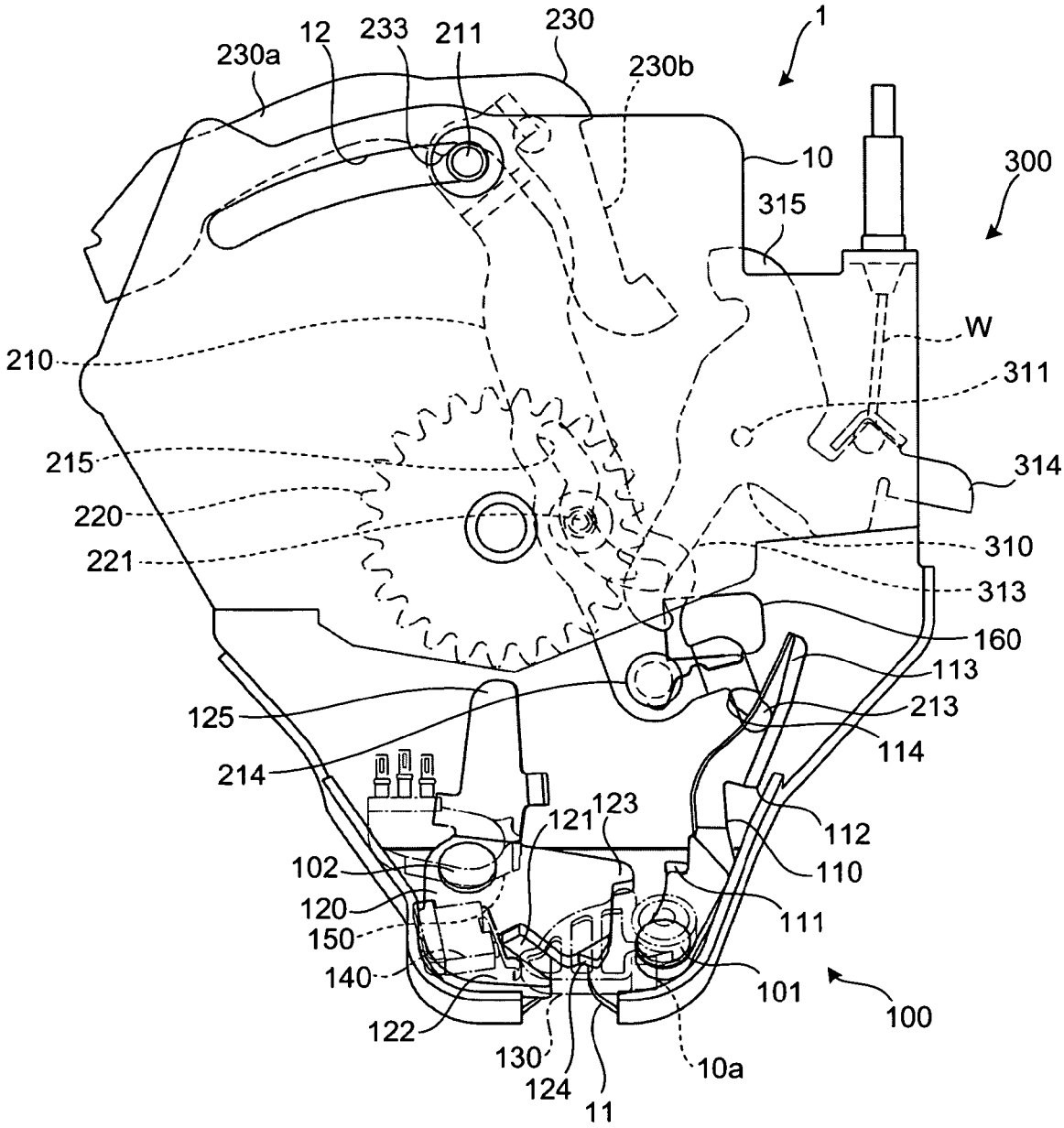
FIG. 15 is a schematic for illustrating an operation of the latch device.

When the latch device 1 enters the state shown in FIG. 14, the opening closing controller 400 continues to drive the latch actuator 201 to swing the output lever 210 in the same direction so that the open-side overstroke state, shown in FIG. 15, is entered. The contacting of the latch engaging portion 111 of the ratchet 110 with the second mesh portion 124 of the latch 120 can thereby be released reliably.

After the open-side overstroke state of FIG. 15 is entered, the opening/closing controller 400 continues to drive the latch actuator 201 to swing the output lever 210 clockwise. Thereafter, when the latch device 1 reaches the open-side neutral state of FIG. 9 and this is confirmed by the detection result of the cam-pin-position detecting switch 250, the driving of the latch actuator 201 is stopped.

On the other hand, when the striker S has actually become removed from the engagement groove 121 of the latch 120 and the striker receiving groove 11 of the base plate 10 by the elastic restoring forces of the return spring 103 and the weather strip in the state shown in FIG. 14 and the opening/closing controller 400 detects, by the door opening/closing switch 140, that the opening/closing switch lever 130 has returned to the advanced position, the opening/closing controller 400 starts driving the open actuator OA provided in the power trunk unit. The trunk lid D can thereby put in the fully-open state with respect to the main vehicle body B.

Here, according to the present embodiment, the positioning of the opening/closing switch lever 130 at the advanced position and the detection thereof by the door opening/closing switch 140 are the conditions for driving the open actuator OA of the power trunk unit. That is, the open actuator OA of the power trunk unit is driven under the condition that, after the engagement groove 121 of the latch 120 is opened, the striker S has actually become removed completely from the engagement groove 121 and has become removed from the striker receiving groove 11 of the base plate 10. The open actuator OA of the power trunk unit is thus not driven, for example, when the striker S is not removed from the engagement groove 121 even though the trunk-opening switch is turned on and the engagement groove 121 of the latch 120 is opened. Thus, even if a load is applied to the trunk lid D with the striker S being positioned in the engagement groove 121 of the latch 120 that is opened and the latch 120 undergoes the engaging operation and enters the half-latch state, the above situation, in which the open actuator OA and the latch actuator 201 operate in mutually different directions and thereby cause a problem, can be prevented reliably.

Subsequently, the operations shown in FIGS. 9 to 15 are performed repeatedly and control of the opening and closing of the trunk lid D with respect to the main vehicle body B is thus enabled.

With the latch device 1, when, for example, a foreign object is nipped between the main vehicle body B and the trunk lid D, the latch 120 cannot be made to transition from the half-latch state to the full-latch state. The clockwise swinging of the output lever 210 about the axis center of the lever shaft 211 positioned at the right end of the slide groove 12 is thus made difficult.

Figure 16:
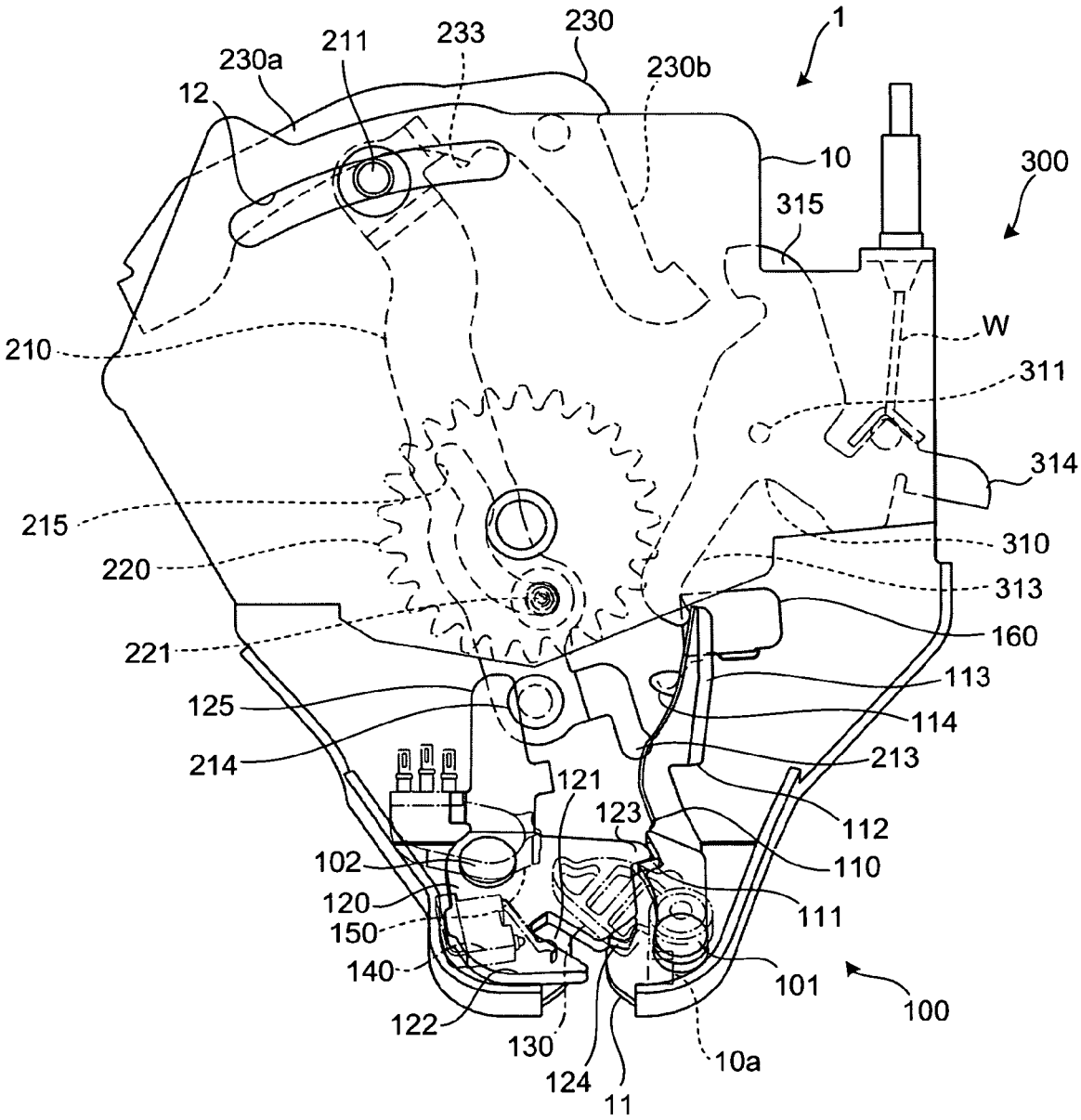
FIG. 16 is a schematic for illustrating an operation of the latch device.
Figure 17:
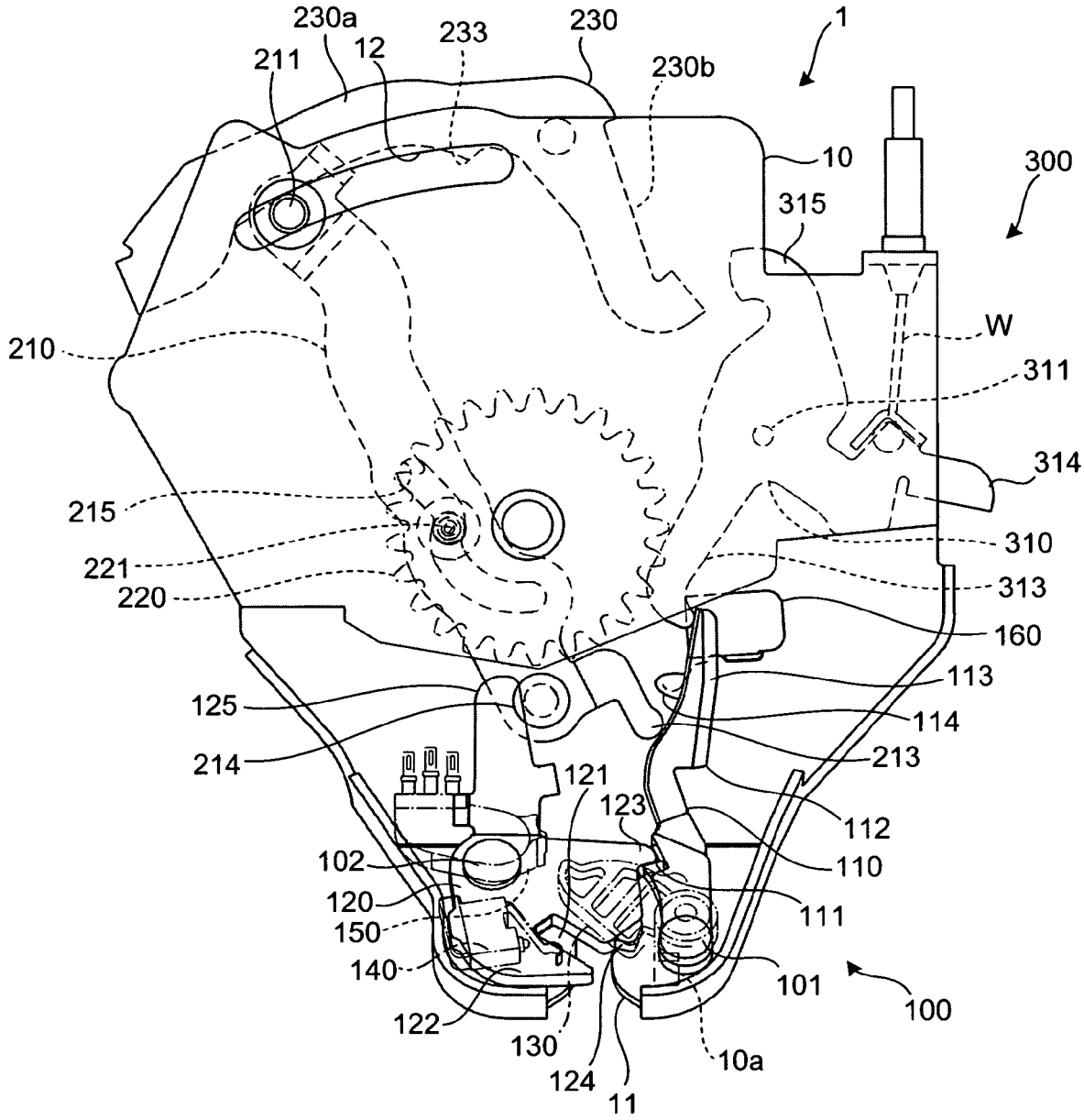
FIG. 17 is a schematic for illustrating an operation of the latch device.

However, with the latch device 1 according to the present embodiment, when the cam driving gear 220 rotates clockwise after the latch 120 reaches a stationary state, the intermediate portion of the output lever 210 is pressed leftward in the figures, and eventually, the lever shaft 211 of the output lever 210 moves beyond the supporting projection 233 against the elastic force of the cancel spring 232 and the elastic force of the lever spring 212. The lever shaft 211 thus moves about the axis center of the latch pin 214 and slides toward the left end along the slide groove 12 of the base plate 10 as shown in FIGS. 16 and 17. Therefore, even when the latch 120 reaches the stationary state, all components of the power transmitting system, that is, the gear train 240, the cam driving gear 220, and the output lever 210 that transmit the power from the latch actuator 201 to the latch 120 operate. Because an overload is thus never applied to these components, these components do not become damaged.

Figure 18:
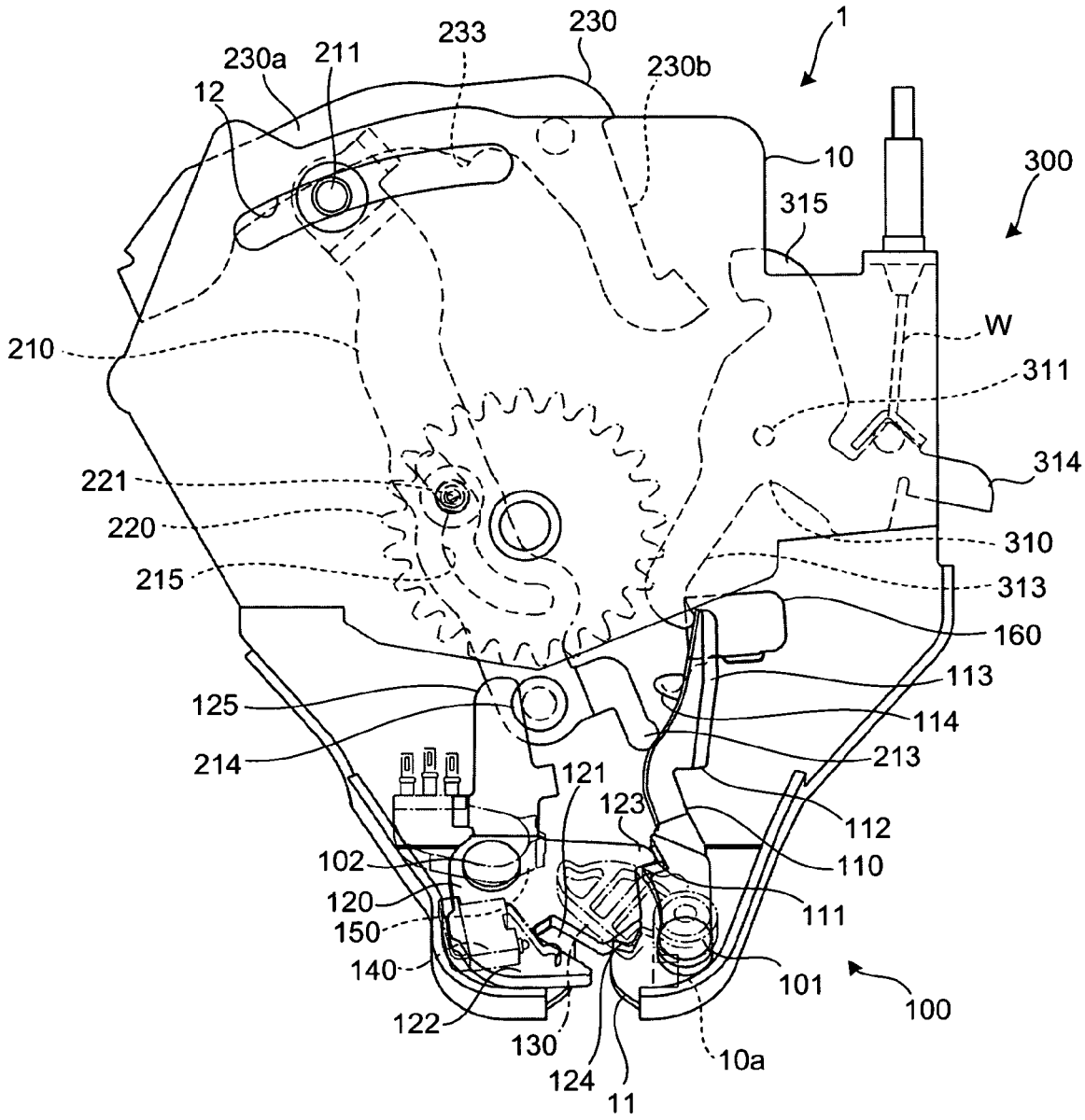
FIG. 18 is a schematic for illustrating an operation of the latch device.
Figure 19:
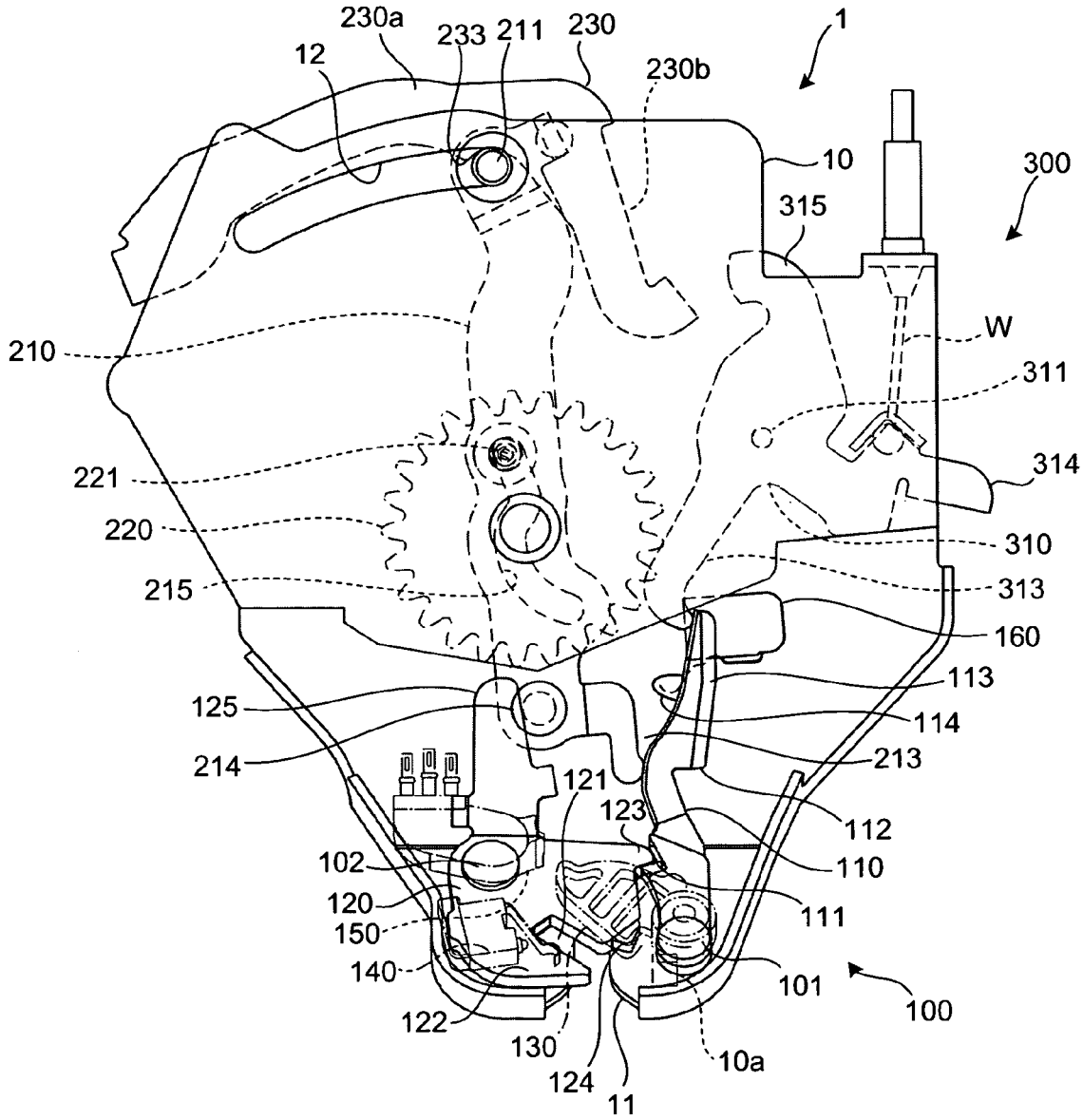
FIG. 19 is a schematic for illustrating an operation of the latch device.

When the cam driving gear 220 rotates thereafter, the lever shaft 211 that has slid along the slide groove 12 is kept again in the state of having returned to the right end of the slide groove 12 by the cooperative actions of the cam pin 221 and the cam groove 215 as shown in FIGS. 18 and 19. Thus, when the trunk-opening switch is turned on in this state, the contacting of the second mesh portion 124 of the latch 120 with the latch engaging portion 111 is released as shown in FIGS. 14 and 15, thereby enabling the trunk lid D to be moved and opened and enabling the foreign object nipped between the main vehicle body B and the trunk lid D to be removed.

Figure 20:
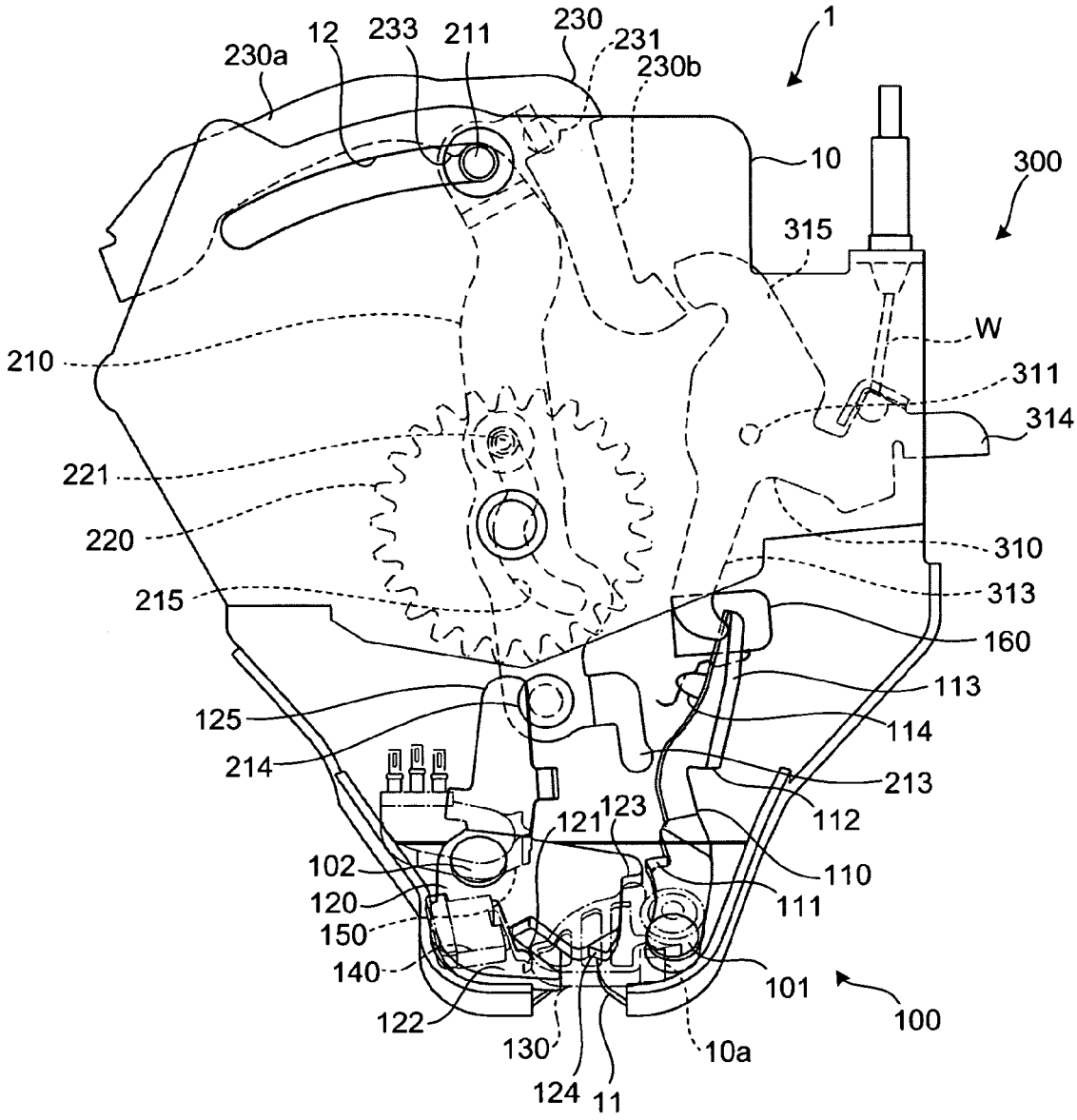
FIG. 20 is a schematic for illustrating an operation of the latch device.

FIG. 20 is a schematic for illustrating an operation when the trunk lid D is opened by manual operation from the closed-side neutral state shown in FIG. 13. That is, when from the closed-side neutral state shown in FIG. 13, a key is inserted into the key cylinder KC of the trunk lid D and the key cylinder KC is then rotated clockwise for example, the rotation of the key cylinder KC is transmitted via the wire cable W and the lever operating portion 314 to the open lever 310 and the open lever 310, set at the initial position, rotates counterclockwise in FIG. 13. The latch release operating portion 313 of the open lever 310 is thereby made to contact the bent edge portion 113 of the ratchet 110 as shown in FIG. 20, and by the ratchet 110 swinging clockwise, the contacting of the second mesh portion 124 of the latch 120 with the latch engaging portion 111 is released. Consequently, the latch 120 is rotated clockwise about the latch shaft 102 by the elastic restoring force of the return spring 103 and the engagement groove 121 of the latch 120 is thereby opened. The state in which the striker S can become removed from the engagement groove 121 of the latch 120 and the striker receiving groove 11 of the base plate 10 is thus entered.

When the striker S thereafter becomes removed from the engagement groove 121 of the latch 120 by the elastic restoring forces of the return spring 103 and the weather-strip and the striker S becomes removed furthermore from the striker receiving groove 11 of the base plate 10 and the return of the opening/closing switch lever 130 to the advanced position is detected by the door opening/closing switch 140, the opening/closing controller 400 drives the open actuator OA of the power trunk unit. The trunk lid D can thereby be put in the fully-opened state with respect to the main vehicle body B.

With the latch device 1, the interval between the cancel operating portion 315 and the pressure receiving portion 230*c* of the cancel lever 230 is set greater than the interval between the latch release operating portion 313 and the bent edge portion 113 of the ratchet 110 so that when the open lever 310 is rotated, the ratchet 110 swings first and the cancel lever 230 swings thereafter. Thus, as shown in FIG. 20, even when the latch engaging portion 111 of the ratchet 110 has been swung clockwise via the latch release operating portion 313 so that the latch engaging portion 111 faces neither the first mesh portion 123 nor the second mesh portion 124, the cancel lever 230 is not swung by the cancel operating portion 315 and the lever shaft 211 of the output lever 210 is held at the right end of the slide groove 12 by the contact with the supporting projection 233.

Thus, to open the trunk lid D by means of the key cylinder KC, it is sufficient to apply an operating force that is enough to rotate the open lever 310 in opposition to the elastic force of the initial position defining spring and enough to swing the ratchet 110 in opposition to the elastic force of the return spring 103.

Figure 21:
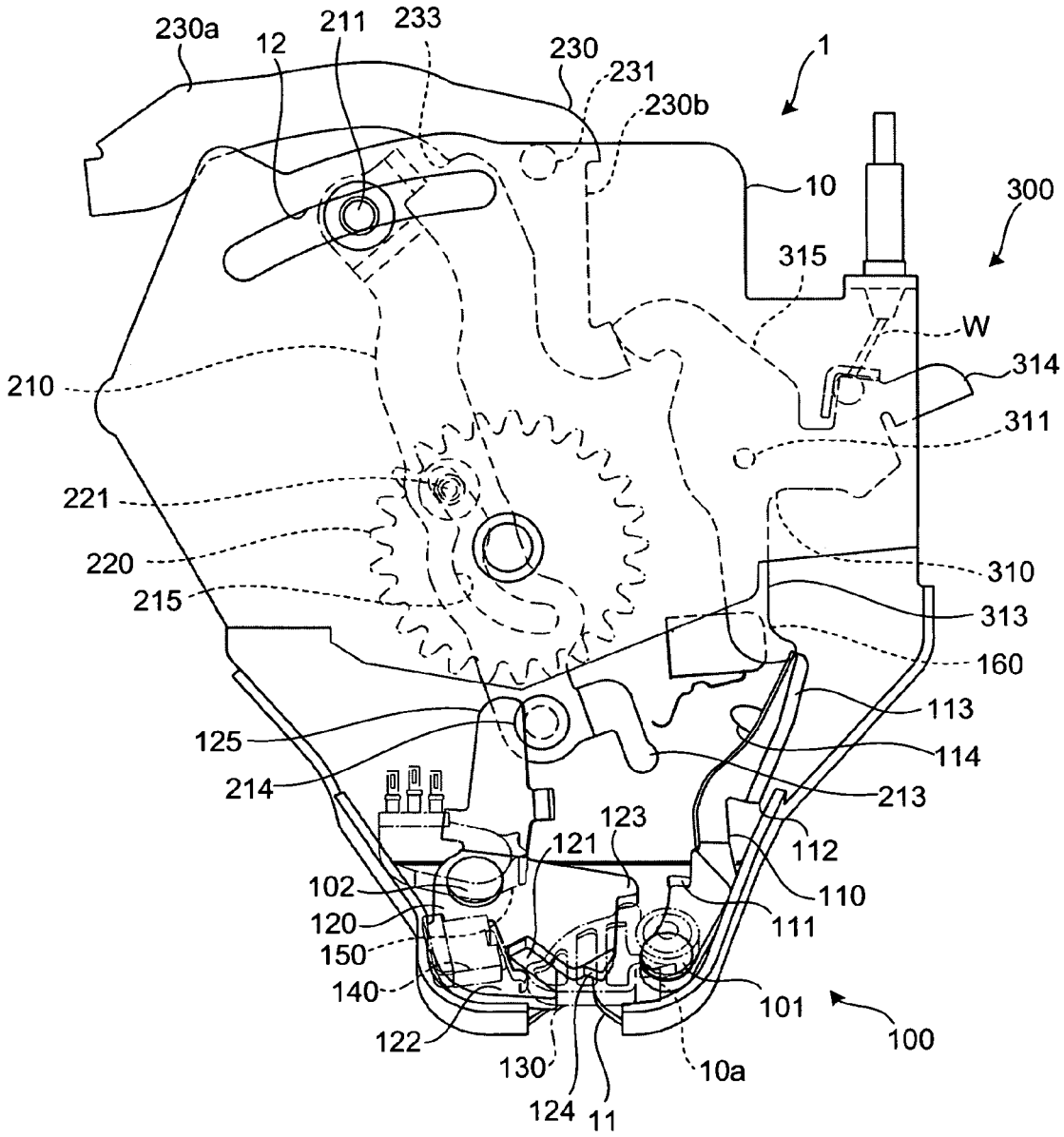
FIG. 21 is a schematic for illustrating an operation of the latch device.

FIG. 21 is a schematic for illustrating an operation when the key cylinder KC is rotated clockwise further from the state of FIG. 20. When the key cylinder KC is rotated clockwise further from the state of FIG. 20, the rotation of the key cylinder KC is transmitted via the wire cable W and the lever operating portion 314 to the open lever 310 and the cancel lever 230 is swung about the axis center of the cancel shaft 231 via the cancel operating portion 315 of the open lever 310. When the cancel lever 230 swings, the supporting projection 233 of the cancel lever 230 separates from the lever shaft 211 of the output lever 210 and the sliding of the lever shaft 211 along the slide groove 12 is enabled. Consequently, in the state shown in FIG. 21, the output lever 210 is released from among the power transmitting system components 210, 220, and 240 that transmit the power from the latch actuator 201 to the latch 120 and even if the cam driving gear 220 is rotated, the latch 120 cannot be rotated by the latch pin 214 of the output lever 210. Oppositely, in the state shown in FIG. 21, the output lever 210 can be rotated counterclockwise in the figure about the cam pin 221 of the cam driving gear 220.

Thus, when, for example, the latch actuator 201 is put in a stationary state in the middle of transitioning from the half-latch state shown in FIG. 10 to the full-latch state shown in FIGS. 11 and 12, by rotating the key cylinder KC by the above key operation, the output lever 210 can be rotated counterclockwise in the figure about the cam pin 221 of the cam driving gear 220 and the engagement of the latch 120 can be released to enable the trunk lid D to be opened. Moreover, because the key cylinder KC is for opening the trunk lid D, the presence thereof is not made ambiguous and problems that occur when the latch actuator 201 is put in the stationary state can be resolved reliably. Furthermore, though to swing the cancel lever 230, the elastic force of the cancel spring 232 must be opposed and an operating force that is greater than normal is required, this oppositely provides the effect of preventing an erroneous operation from being performed unnecessarily.

With the latch device 1, the latch actuator 201 is driven only when, after the entry of the striker S into the striker receiving groove 11 is detected by the door opening/closing switch 140, the latch device 1 is judged to be in the half-latch state based on the counterclockwise swinging of the ratchet 110 detected by the ratchet switch 160 and the rotation position of the latch 120 detected by the latch switch 150. Thus, even when, for example, the ratchet switch 160 erroneously detects the swinging of the ratchet 110, the latch 120 does not rotate clockwise about the axis center of the latch shaft 102. Thus, when the trunk lid D is closed, the striker S always enters the engagement groove 121 of the latch 120 and the trunk lid D can thus be closed reliably with respect to the main vehicle body B.

With the latch device 1 and the door opening/closing control device, the open actuator OA of the power trunk unit is driven under the conditions that the striker S has actually become removed completely from the engagement groove 121 of the latch 120, the opening/closing switch lever 130 is positioned at the advanced position, and this positioning is detected by the door opening/closing switch 140. The open actuator OA of the power trunk unit is thus not be driven, for example, when the striker S is not removed from the engagement groove 121 even though the trunk-opening switch is turned on and the engagement groove 121 of the latch 120 is opened. Thus, even if a load is applied to the trunk lid D with the striker S being positioned in the engagement groove 121 of the latch 120 that is open and the latch 120 undergoes the engaging operation and enters the half-latch state, the situation, in which the open actuator OA and the latch actuator 201 operate in mutually different directions and thereby cause a problem, can be prevented reliably.

In the present embodiment, the latch device 1 provided between the main body of the vehicle and the trunk lid has been explained. The present invention can also be applied to a latch device that keeps other doors in a closed state.

In the present embodiment, the full-latch state is released by driving the latch actuator. However, the full-latch state does not have to be released by the actuator necessarily.

Furthermore, according to the present embodiment, the striker is provided on the main vehicle body and the latch device is provided on the door. However, the striker and the latch device may be provided in a reverse manner instead.

Yet furthermore, according to the present embodiment, because after the striker has become removed from the engagement groove of the latch, that the striker has become removed from the striker receiving groove of the main device body is detected, the opening/closing control of the door can be performed more accurately. However, the striker detecting unit may instead be arranged to detect the removal of the striker from the latch engagement groove when this removal occurs.

According to the embodiments described above, it is possible to detect that the striker has actually entered the striker receiving groove, and to avoid erroneous actuation of a latch actuator.

Moreover, according to the embodiments described above, it is possible to accurately control opening and closing of a door.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

This application claims priority from Japanese Patent Application 2005-151070, filed May 24, 2005, Japanese Patent Application 2005-151071, filed May 24, 2005 and Japanese Patent Application 2005-151072, filed May 24, 2005, which are incorporated herein by reference in their entirety.

What is claimed is:

1. A latch device for a door on a vehicle body, comprising:

a latch having an engagement groove configured to receive and engage with a striker such that an opening movement of the door with respect to the vehicle body is restricted when the striker is engaged with the engagement groove;

a ratchet configured to rotate about a ratchet axis and to engage with the latch;

a base plate having a receiving groove configured to receive the striker;

a switch lever at an open end of the receiving groove, wherein the switch lever is configured to rotate about the ratchet axis independently of the ratchet from an advanced position at which the switch lever closes an open end of the receiving groove, such that the striker is prevented from entering the receiving groove, to a retreated position at which the switch lever leaves the open end of the receiving groove open as the striker enters the receiving groove;

a first detecting unit configured to engage with the switch lever and to detect that the switch lever is at the advanced position when the first detecting unit is in engagement with the switch lever, and to detect that the switch lever has moved away from the advanced position towards the retreated position when the first detecting unit is no longer in engagement with the switch lever;

a second detecting unit configured to engage with the latch and to detect whether the latch is in a half-latch state in which the door is not completely closed with respect to the vehicle body but the opening movement of the door with respect to the vehicle body is restricted; and a third detecting unit configured to engage with the ratchet and to detect whether the ratchet is at the half-latch state, wherein the latch device is configured such that when the second and third detecting units detect that the latch and ratchet have moved to the half-latch state after the first detecting unit has detected that the switch lever has moved away from the advanced position towards the retreated position a latch actuator is driven to move the latch, the ratchet, and the striker into a full latch state in which the door is completely closed with respect to the vehicle body.

2. The latch device according to claim 1, further comprising an open actuator configured to move the door open, wherein the open actuator is not driven unless the first detecting unit detects that the switch lever is at the advanced position.

3. A door opening/closing control device configured to control the latch device according to claim 2, wherein the door opening/closing control device is configured to drive the open actuator and the latch actuator.

* * * * *